US009016685B2

(12) United States Patent
Yasuda et al.

(10) Patent No.: US 9,016,685 B2
(45) Date of Patent: Apr. 28, 2015

(54) SHEET FEEDING DEVICE AND IMAGE FORMING APPARATUS

(75) Inventors: Junji Yasuda, Kawasaki (JP); Masashige Tamura, Kawasaki (JP); Shinichi Nishida, Kawasaki (JP); Tomokazu Morita, Mishima (JP); Kazumasa Shibata, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/525,783

(22) Filed: Jun. 18, 2012

(65) Prior Publication Data

US 2013/0009355 A1 Jan. 10, 2013

(30) Foreign Application Priority Data

Jul. 7, 2011 (JP) ..... 2011-150965

(51) Int. Cl.

| | |
|---|---|
| ***B65H 3/52*** | (2006.01) |
| ***B65H 3/46*** | (2006.01) |
| ***B65H 1/14*** | (2006.01) |
| ***B65H 3/06*** | (2006.01) |

(52) U.S. Cl.

CPC .. *B65H 3/46* (2013.01); *B65H 1/14* (2013.01); *B65H 3/0607* (2013.01); *B65H 2403/42* (2013.01); *B65H 2403/544* (2013.01); *B65H 2403/732* (2013.01); *B65H 2403/942* (2013.01); *B65H 2405/1117* (2013.01); *B65H 2513/412* (2013.01); *B65H 2557/352* (2013.01); *B65H 2801/06* (2013.01)

(58) Field of Classification Search

USPC ..... 271/167, 147, 264, 157, 121, 122, 124, 271/114, 117, 118, 19, 109, 119, 120, 126, 271/127, 128

See application file for complete search history.

(56) References Cited

U.S. PATENT DOCUMENTS

| | | | | |
|---|---|---|---|---|
| 5,419,543 | A * | 5/1995 | Nakamura et al. | 271/9.01 |
| 6,332,608 | B1 | 12/2001 | Tamura | |
| 6,516,166 | B2 | 2/2003 | Sakakibara et al. | |
| 6,520,497 | B2 | 2/2003 | Tamura | |
| 6,533,263 | B2 | 3/2003 | Tamura | |
| 6,804,474 | B2 | 10/2004 | Morita et al. | |
| 6,947,679 | B2 | 9/2005 | Kato et al. | |
| 2004/0256789 | A1 * | 12/2004 | Hsu | 271/126 |
| 2010/0156033 | A1 * | 6/2010 | Lee | 271/121 |

FOREIGN PATENT DOCUMENTS

| | | | |
|---|---|---|---|
| JP | 57-102444 | * | 6/1982 |
| JP | 58-022224 | A | 2/1983 |
| JP | 59-128145 | * | 7/1984 |
| JP | 62-059008 | B | 12/1987 |
| JP | 2-158541 | * | 6/1990 |
| JP | 5-147752 | A | 6/1993 |
| JP | 6-199439 | * | 7/1994 |

* cited by examiner

*Primary Examiner* — Thomas Morrison

(74) *Attorney, Agent, or Firm* — Fitzpatrick, Cella, Harper & Scinto

(57) ABSTRACT

Provided are a sheet feeding device capable of preventing the occurrence of failure in sheet feeding and degradation in quality of printed matter with downsizing achieved and an image forming apparatus provided with the sheet feeding device.

The sheet feeding device includes a sheet storing portion 55 in which sheets are stored, a feeding roller 51 placed above the sheet storing portion, a flexible member 53 placed along part of the peripheral surface of the feeding roller with one end of the flexible member fixed to the sheet storing portion at a position below the stored sheets, and a pulling-up portion 300 that is connected to the other end of the flexible member above the sheet storing portion and that pulls up the flexible member to press the sheet on the feeding roller.

10 Claims, 22 Drawing Sheets

SHEET FEEDING DEVICE AND IMAGE FORMING APPARATUS

BACKGROUND OF THE INVENTION

1. Field of the Invention

The present invention relates to sheet feeding devices and image forming apparatuses, and in particular, relates to a sheet feeding device downsized without causing failure in sheet feeding and degradation in quality of printed matter and to an image forming apparatus downsized by being provided with the downsized sheet feeding device.

2. Description of the Related Art

Conventionally, image forming apparatuses, such as facsimile machines, copying machines, and laser beam printers, have been each provided with a sheet feeding device for feeding sheets, such as plain paper, coated paper, plastic sheets, and cloth, to an image forming portion in the image forming apparatus. In sheet feeding devices, it is very important to separate sheets one by one for their sending to image forming portions; therefore, to prevent multifeeding, i.e., feeding plural sheets from a sheet feeding device at one time, various sheet feeding methods have been proposed.

Moreover, in recent years, great importance has been placed on downsizing of sheet feeding devices as well as multifeeding prevention and stable sheet feeding. And further, with the widespread use of printers, facsimile machines and so on in ordinary households, it is demanded that image forming apparatuses be further downsized as well. In image forming apparatuses each provided with a sheet tray (sheet feeding cassette) in which sheets are stored, it is demanded that the dimension in the direction of the fitting of the sheet tray (hereinafter referred to as "the dimension of the fitting direction") of the main body of the apparatus, in particular, do not exceed the dimension of the fitting direction of the sheet tray.

As an example of a sheet feeding device in which the dimension of the fitting direction of an image forming apparatus falls within the dimension of the fitting direction of a sheet tray, there is a sheet feeding device in which a sheet feeding roller is rotated forward and backward to separate sheets one by one (see Japanese Patent Laid-Open No. 5-147752). In such a sheet feeding device, when feeding sheets, the sheet feeding roller is rotated backward to begin with to feed the uppermost sheet in a sheet tray in the direction opposite to the direction of the sheet feeding. As a result, the uppermost sheet is bent once by being pressed on the back wall of the sheet tray for the separation of the sheet from the other sheets.

Thereafter, by rotating the sheet feeding roller forward, the sheet bent once goes up on a separation claw provided downstream in the direction of the sheet feeding of the sheet tray, whereby the sheets are separated one by one. By using such a mechanism, the function of feeding sheets separately can be provided within the dimension in the fitting direction of the sheet tray, and this enables the achievement of the dimension of the fitting direction of the image forming apparatus falling within the dimension of the fitting direction of the sheet tray.

Moreover, as another example, there is a sheet feeding device having a component that can be folded in a state of being stored with sheets, i.e., using a method in which sheets are put in the sheet tray in a state of being bent (see Japanese Patent Laid-Open No. 58-22224). Therefore, the provision of such a sheet feeding device enables the implementation of an image forming apparatus smaller than sheets used for image formation.

However, for such related art sheet feeding devices, in the case where, for example, a sheet is bent once to separate the sheet from the other sheets, it is necessary to provide a space for bending sheets above the sheet tray, and thus the height of the device increases. In the case where sheets are put in the sheet tray in a state of being curved, when the sheets have been held curved for a long time period, there is a possibility that the sheets curve at all times at their bent portions. Therefore, the feeding of such sheets curving at all times causes problems such as sheet feeding failures (paper jams, etc.) and transfer failures at the times of the transfer of an image onto sheets. And further, there is a possibility that only part of printed matter on which an image has been formed curves at all times, and thus a problem arises that the quality of the printed matter degrades.

In view of the present circumstances, the present invention provides a sheet feeding device capable of preventing the occurrence of failure in sheet feeding and degradation in quality of printed matter with downsizing achieved and an image forming apparatus provided with the downsized sheet feeding device.

SUMMARY OF THE INVENTION

According to one aspect of the present invention, a sheet feeding device includes a sheet storing portion, a feeding roller, a flexible member, and a pulling-up portion. In the sheet storing portion, sheets are stored. The feeding roller is placed above the sheet storing portion. The flexible member is placed along part of the peripheral surface of the feeding roller with one end of the flexible member fixed to the sheet storing portion at a position below the stored sheets. The pulling-up portion is connected to the other end of the flexible member above the sheet storing portion, and pulls up the flexible member to press the sheet on the feeding roller.

As described in the present invention, at the time of sheet feeding, the flexible member is pulled up to press a sheet on the feeding roller, and then the sheet is fed along the flexible member. Therefore, the occurrence of failure in sheet feeding and degradation in quality of printed matter can be prevented with downsizing achieved.

Further features of the present invention will become apparent from the following description of exemplary embodiments with reference to the attached drawings.

DESCRIPTION OF THE EMBODIMENTS

Figure 1:
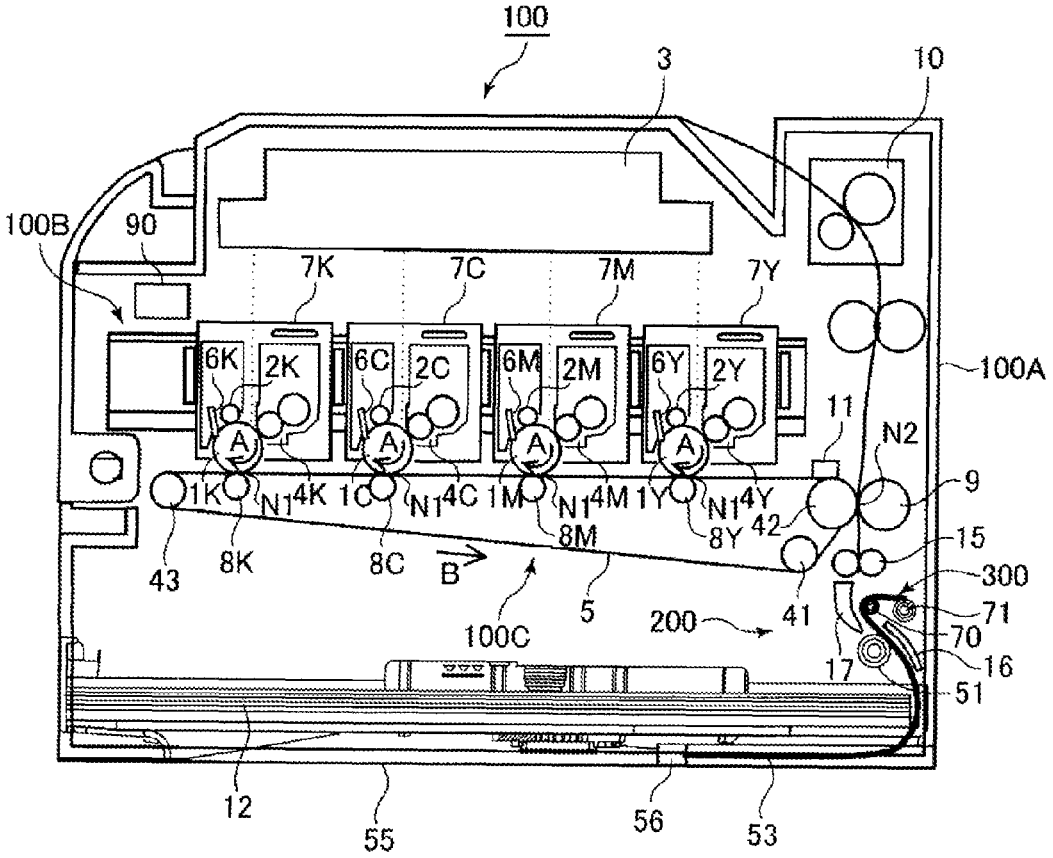
FIG. 1 illustrates the general arrangement of a full-color laser printer that is one example of an image forming apparatus provided with a sheet feeding device according to a first embodiment of the present invention.

Several embodiments of the present invention will be described in detail below with reference to the accompanying drawings. FIG. 1 illustrates the general arrangement of a full-color laser printer as one example of an image forming apparatus provided with a sheet feeding device according to a first embodiment of the present invention. As shown in FIG. 1, the full-color laser printer 100 has a full-color laser printer body (hereinafter referred to as "printer body") 100A. The printer body 100A as the main body of the printer 100 includes an image forming portion 100B that forms an image on sheets, such as recording paper, plastic sheets, or cloth, and a sheet feeding device 200 that feeds the sheets to the image forming portion 100B.

The image forming portion 100B includes process cartridges 7 (7Y, 7M, 7C, and 7K) that form a four-color toner image, i.e., respectively form a yellow toner image, a magenta toner image, a cyan toner image, and a black toner image. The process cartridges 7Y, 7M, 7C, and 7K are detachably fit in the printer body 100A, and respectively include photosensitive drums 1, i.e., 1Y, 1M, 1C, and 1K as image bearing members that are rotatably driven in the direction of arrows A (clockwise) by driving units (driving sources) (not shown).

The image forming portion 100B includes a scanner unit 3 that is placed directly above the process cartridges 7 and that irradiates laser beams based on image information to form electrostatic latent images on the photosensitive drums 1. And further, the process cartridges 7Y, 7M, 7C and 7K respectively include development units 4 (4Y, 4M, 4C, and 4K) and charging rollers 2 (2Y, 2M, 2C, and 2K) in addition to the photosensitive drums 1. The development units 4 each adhere toner to the electrostatic latent image and then develop the image to form a toner image. The charging rollers 2 each evenly charge the peripheral surface of the corresponding photosensitive drum 1. Also, the process cartridges 7Y, 7M, 7C, and 7K respectively include cleaner units 6 (6Y, 6M, 6C and 6K).

As shown in FIG. 1, an intermediate transfer belt unit 100C includes an endless intermediate transfer belt 5 and first-order transfer rollers 8 (8Y, 8M, 8C, and 8K) provided inside the intermediate transfer belt 5 such that the first-order transfer rollers 8Y, 8M, 8C, and 8K are respectively opposite to the photosensitive drums 1Y, 1M, 1C, and 1K. The intermediate transfer belt 5 is looped over a driving roller 41, a second-order transfer counter roller 42, and a driven roller 43 with a tension applied, and turns in the direction of an arrow B while abutting all the photosensitive drums 1.

The first-order transfer rollers 8 press the intermediate transfer belt 5 on the photosensitive drums 1 to provide first-order transfer portions N1 where the intermediate transfer belt 5 and the photosensitive drums 1 abut on each other, and then apply first-order transfer biases to the intermediate transfer belt 5 by using bias applying units (not shown). Consequently, the toner images of the different colors on the photosensitive drums 1 are transferred onto the intermediate transfer belt 5 in order, whereby a full-color image is formed on the intermediate transfer belt 5.

At a position opposite to the second-order transfer counter roller 42 on the peripheral surface of the intermediate transfer belt 5, a second-order transfer roller 9 is provided: by pressing the second-order transfer roller 9 on the second-order transfer counter roller 42 via the intermediate transfer belt 5, a second-order transfer portion N2 is formed. To the second-order transfer roller 9, a bias having a polarity opposite to the normal charge polarity of the toner is applied by a second-order transfer bias power supply (a high-voltage power supply) as a second-order transfer bias applying unit (not shown). As a result, the toner image on the intermediate transfer belt 5 is transferred to a sheet 12 (is subjected to a second-order transfer to the sheet 12).

The sheet feeding device 200 includes a sheet tray 55 detachably fit to the printer body 100A and a sheet feeding roller (a feeding roller) 51 that feeds the sheets 12 stored in the sheet tray 55. At the time of feeding of the sheet 12, by rotating the sheet feeding roller 51 while pressing the sheet 12 on the roller 51, the sheet 12 is sent off.

Next, image forming operation of the full-color laser printer 100 having such a structure will now be described. To begin with, an image signal is input from an image scanning device (not shown) connected to the printer body 100A, a host apparatus, such as a personal computer, or the like to the scanner unit 3, following which the scanner unit 3 irradiates the peripheral surfaces of the photosensitive drums 1 with laser light corresponding to the image signal. At that time, the peripheral surfaces of the photosensitive drums 1 are already electrically charged by the charging rollers 2 evenly such that the peripheral surfaces have predetermined polarities and potentials, and therefore electrostatic latent images are formed on the peripheral surfaces by the laser light irradiation by the scanner unit 3. Thereafter, the electrostatic latent images are developed by the development units 4 to generate visible images.

For example, to begin with, the scanner unit 3 irradiates the photosensitive drum 1Y with laser light generated based on an image signal carrying yellow components to form a yellow electrostatic latent image on the peripheral surface of the photosensitive drum 1Y. Then the development unit 4Y develops the yellow electrostatic latent image by using yellow toner to make the image visible as a yellow toner image. Thereafter, the photosensitive drum 1Y is rotated so that the toner image reaches the first-order transfer portion N1 at which the photosensitive drum 1Y and the intermediate transfer belt 5 abut on each other, where the yellow toner image on the photosensitive drum 1Y is transferred onto the intermediate transfer belt 5 by applying a first-order transfer bias to the first-order transfer roller 8Y.

Then the part bearing the yellow toner image of the intermediate transfer belt 5 is moved to the next first-order transfer portion N1, where a magenta toner image, which has been formed on the peripheral surface of the photosensitive drum 1M by using the same method as that described above, is transferred to the part of the intermediate transfer belt 5 such that the magenta toner image is superimposed on the yellow toner image. Likewise, when the intermediate transfer belt 5 has been turned to the next two first-order transfer portions N1, a cyan toner image and a black toner image are transferred in order such that both the images are superimposed on the yellow toner image and the magenta toner image, whereby a full-color toner image is formed on the intermediate transfer belt 5. Note that, the toner remaining on the peripheral surface of each photosensitive drum 1 after the toner image transfer is cleared away by the cleaner unit 6.

The sheet 12 in the sheet tray 55 as a sheet storing portion is sent off by the sheet feeding roller 51, and conveyed to a resist roller 15 concurrently with the toner image forming operation. Then the sheet 12 conveyed to the resist roller 15 is conveyed to the second-order transfer portion N2 with timing provided by the resist roller 15.

At the second-order transfer portion N2, the four-color toner image on the intermediate transfer belt 5 is subjected to a second-order transfer to the conveyed sheet 12 by applying a positive bias to the second-order transfer roller 9. Note that, the toner remaining on the intermediate transfer belt 5 after the second-order transfer of the toner image is cleared away by a belt cleaner 11. After the toner image transfer, the sheet 12 is conveyed to a fixing portion 10, where the sheet 12 is heated under pressure to fix the full-color toner image, whereby a permanent image is generated. Thereafter, the sheet 12 is discharged outside the printer body 100A.

Next, the sheet feeding device 200 according to this embodiment will now be described. The sheet feeding device 200 includes the sheet tray 55 in which sheets are stored in a state of being stacked, the sheet feeding roller 51, and a sheet pulling-up unit 300 that pulls up the sheet and presses the sheet on the sheet feeding roller 51 at the time of feeding of the sheet by the sheet feeding roller 51.

Note here that, the sheet feeding roller 51 and the sheet pulling-up unit 300 are placed above the sheet tray 55. Therefore, the dimension in the direction of fitting of the sheet tray 55 of the printer body 100A can be made smaller than or equal to the dimension in the sheet fitting direction of the sheet tray 55.

Figure 2A:
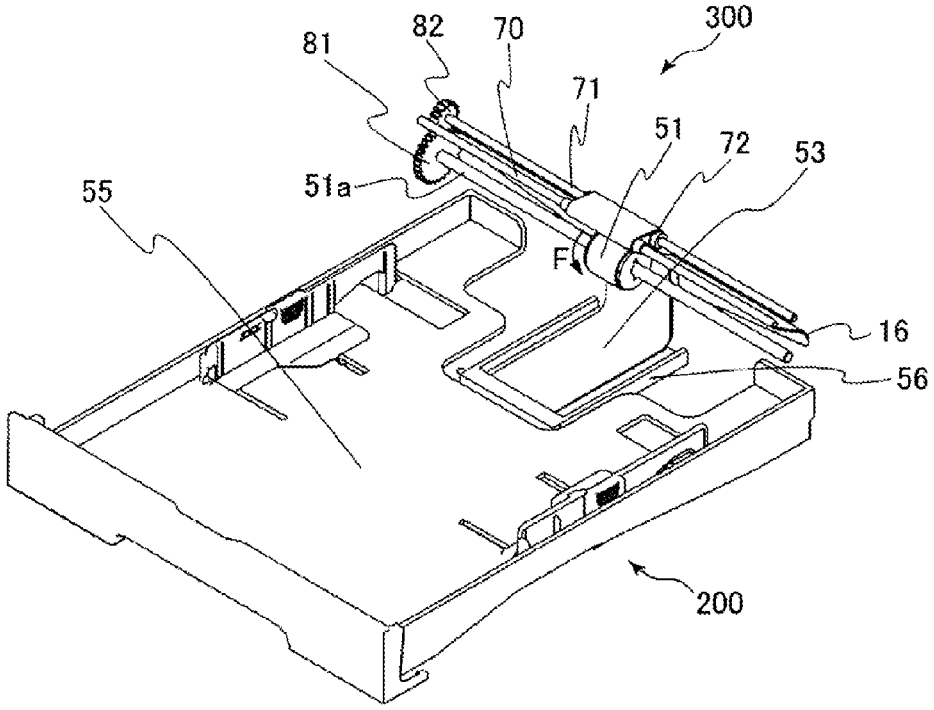
FIGS. 2A and 2B are each a first explanatory drawing of the structure of the sheet feeding device according to the first embodiment.
Figure 2B:
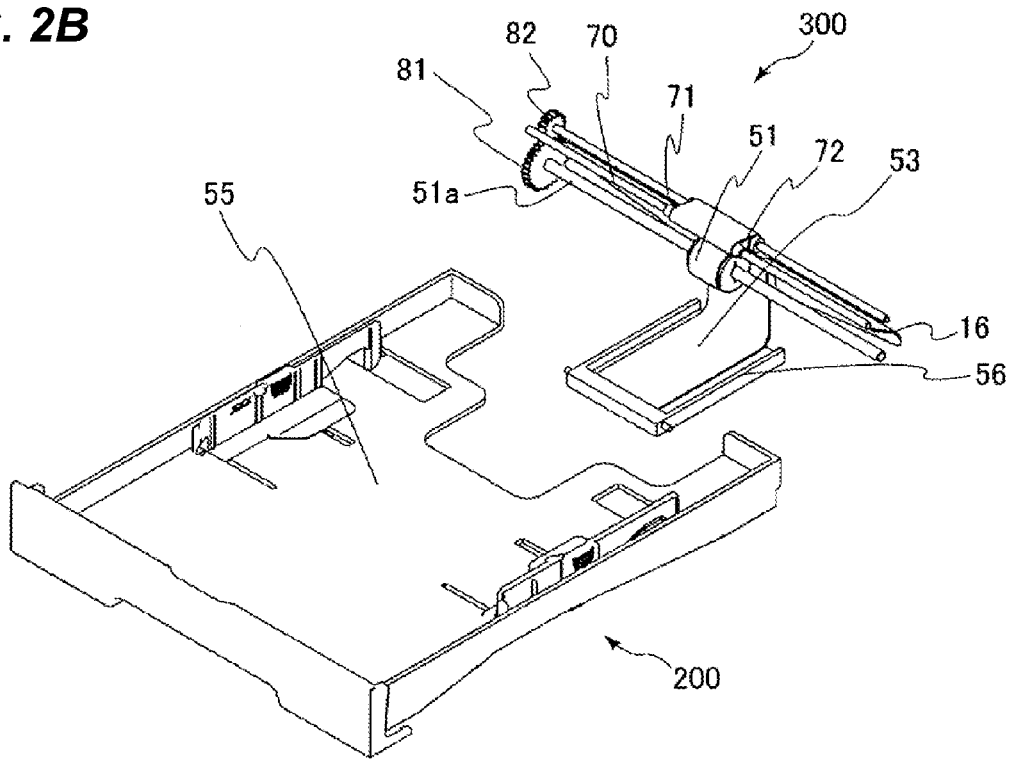
Figure 3A:
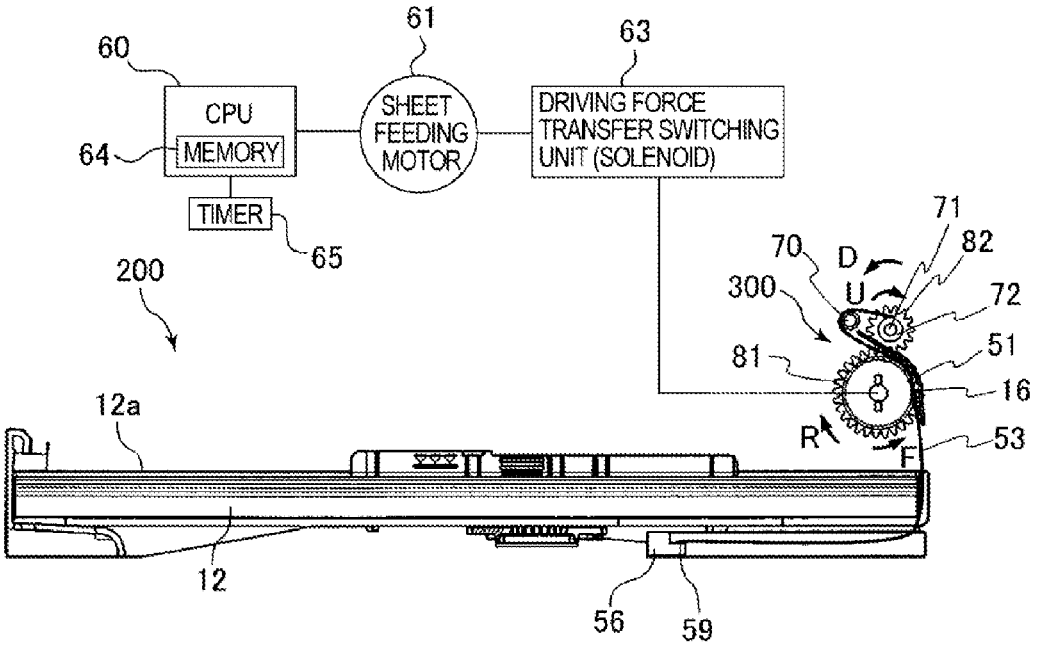
FIGS. 3A and 3B are each a second explanatory drawing of the structure of the sheet feeding device according to the first embodiment.
Figure 3B:
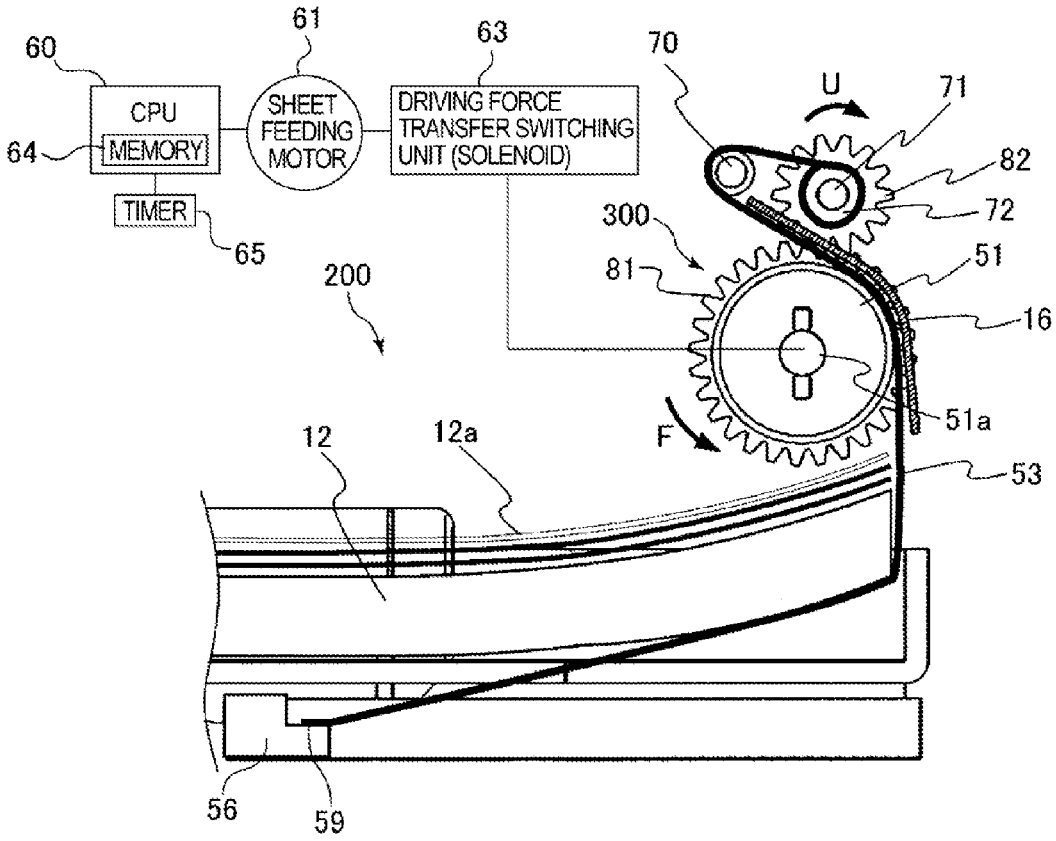

Now, as shown in FIGS. 2A and 2B, a sheet feeding roller gear 81 is fixed to the sheet feeding shaft 51*a* of the sheet feeding roller 51. To the sheet feeding roller gear 81, a rotational driving force from a backward rotatable sheet feeding motor 61 of FIGS. 3A and 3B is transferred via a gear (not shown). Through the transfer of the rotational driving force from the sheet feeding motor 61, the sheet feeding roller 51 rotates in a sheet feeding direction indicated by an arrow F or in the direction opposite to the sheet feeding direction (hereinafter referred to as "opposite direction") indicated by an arrow R. When the sheet feeding roller 51 has rotated in the sheet feeding direction while abutting the uppermost sheet 12*a* of the sheets 12 in the sheet tray 55, the uppermost sheet 12*a* is sent out; when the sheet feeding roller 51 has rotated in the opposite direction, the uppermost sheet 12*a* is sent backward.

As shown in FIGS. 3A and 3B, between the sheet feeding motor 61 and the sheet feeding roller 51, a solenoid 63 is provided as a driving force transfer switching unit that engages and disengages the sheet feeding roller gear 81 and the gear (not shown). By turning on the solenoid 63 and rotating the sheet feeding motor 61 forward or backward, the directions of rotation of the sheet feeding roller 51 can be switched.

The sheet pulling-up unit 300 includes a sheet member 53 as a flexible member, a sheet running shaft 70 and a sheet taking-up shaft 71 both provided in parallel with the sheet feeding shaft 51*a*, a torque limiter 72, and a conveyance guide 16. Note here that, the sheet member 53 is a member to hold up the front end portions of the sheets 12, i.e., the downstream end portions in the feeding direction of the sheets 12 and to press the sheet 12 on the sheet feeding roller 51 by using a method in which the sheet member 53 is pulled up by being taken up by the sheet taking-up shaft 71.

In the sheet member 53, a low end portion, i.e., an upstream end portion in the sheet feeding direction is joined via a sheet member joining portion 59 to a sheet fixing member 56 provided to the printer body 100A. Further, the sheet member 53 is routed on the sheet running shaft 70, and the other end, i.e., the high end of the sheet member 53 is fixed via the torque limiter 72 to the sheet taking-up shaft 71 that is a rotating member that rotates in conjunction with the rotation of the sheet feeding roller 51 to take up the sheet member 53.

The sheet running shaft 70 is a member to control the direction of a movement of the sheet member 53, i.e., serve as a guide to assist the sheet member 53 in guiding the sheet 12 in a predetermined direction. The conveyance guide 16 is provided along the sheet feeding roller 51: between the conveyance guide 16 and the sheet feeding roller 51, the sheet member 53 is routed. To one end of the sheet taking-up shaft 71 that takes up the sheet member 53, a taking-up gear 82 is fixed in a state of engaging with the sheet feeding roller gear 81. The sheet taking-up shaft 71 rotates with a driving force from the sheet feeding motor 61 transferred via the sheet feeding roller gear 81 and the taking-up gear 82, whereby the sheet member 53 is taken up.

The sheet member 53 can be made of a flexible resin sheet such as a polyester film, a polyphenylene-sulfide film, or a polycarbonate film: the thickness of the sheet member 53 is preferably 50 to 250 μm. Note that, as the sheet member 53 according to this embodiment, a 150-μm-thick polyester film is used.

Now, the sheet feeding roller 51 and the sheet pulling-up unit 300 are fitted to the printer body 100A, and the sheet tray 55 is detachably fitted to the printer body 100A. FIG. 2B illustrates a state in which, for example, since sheets 12 in the sheet tray 55 ran out, the sheet tray 55 has been drawn out of the printer body 100A for a sheet supply. FIG. 2A illustrates a state in which the sheet tray 55 is fitted to the printer body 100A; when the sheet tray 55 has been fit, the front end portions of the sheets 12 stacked on the sheet tray 55 are above the sheet fixing member 56, i.e., on the sheet member 53. That is, in this embodiment, the sheet tray 55 and the sheet fixing member 56 constitute a sheet storing portion. Further, when the sheet tray 55 has been fit, the front end portions of the sheets 12 are on the sheet member 53.

Now, in this embodiment, at the time of feeding of sheets 12, the sheet feeding motor 61 is rotated to take up the sheet member 53 by the sheet taking-up shaft 71, whereby the sheet member 53 is pulled up to press the sheet 12 on the sheet feeding roller 51. Note here that, the time for the rotation of the sheet feeding motor 61 is set by a CPU 60 of FIGS. 3A and 3B according to sheet size. Specifically, the CPU 60 selects a rotation time corresponding to a sheet size from a data table showing the relationship between sheet sizes and rotation times preloaded in a memory 64 in the CPU 60, sets a timer 65 for the selected time, and rotates the sheet feeding motor 61 only for the time set.

Note that, when feeding a sheet, the solenoid 63 is turned on to transfer the rotation of the sheet feeding motor 61 to the sheet feeding roller 51. The time between the above turning-on and the next turning-off of the solenoid 63 can be set as a sufficient time for the front end of the sheet to reach the resist roller 15. In other words, the time between the start and halt of the driving of the sheet feeding roller 51 can be set as a sufficient time for the front end of a sheet to reach the resist roller 15 without respect to the size of the sheet. Therefore, the CPU 60 drives the sheet feeding roller 51 only for a predetermined fixed time, i.e., only for a sufficient time for the front end of a sheet to reach the resist roller 15. Note that, the timer 65 measures elapsed time based on a count by a CPU internal clock.

Next, sheet feeding operation of the sheet feeding device 200 according to this embodiment will now be described. Before the start of sheet feeding operation, the sheet feeding roller 51 and the sheets 12 are in a state of being out of contact with each other as shown in FIG. 3A. When having received a command to start the feeding of the sheets 12 from the host apparatus or the like in such a state, the CPU 60 rotationally drives the sheet feeding motor 61, and at the same time turns on the solenoid 63 to transfer a driving force to the sheet feeding roller 51, whereby the sheet feeding roller 51 starts to rotate in the direction of the arrow F.

Further, the rotational driving force from the sheet feeding motor 61 is transferred from the sheet feeding roller gear 81 to the taking-up gear 82, the sheet taking-up shaft 71 rotates in the direction of an arrow U, and the torque limiter 72 provided to the sheet taking-up shaft 71 also rotates in the direction of the arrow U. As a result, the sheet member 53 is taken up by the sheet taking-up shaft 71, whereby the sheet member 53 is pulled up, and then pressed on the sheet feeding roller 51.

Note that, at the step of pressing the sheet member 53 on the sheet feeding roller 51 like this, a force assisting the taking-up of the sheet member 53 is applied from the sheet feeding roller 51 to the sheet member 53. In addition, since the low end portion of the sheet member 53 is joined to the sheet fixing member 56, the apparent length of the sheet member 53 becomes short when having been taken up. Therefore, the sheet member 53 is pulled up, whereby the sheets 12 are pulled up in the direction of contact with the sheet feeding roller 51 as shown in FIG. 3B.

Figure 4A:
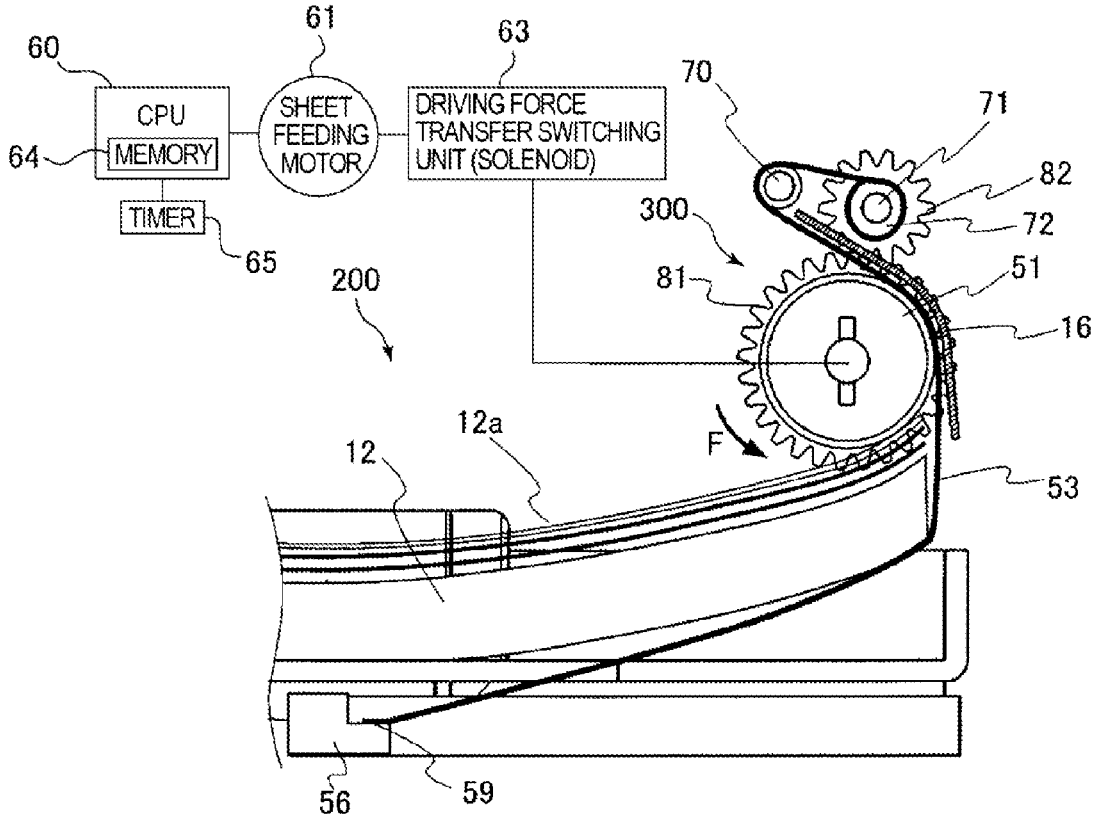
FIGS. 4A and 4B are each an explanatory drawing of sheet feeding operation of the sheet feeding device according to the first embodiment.

After further taking-up of the sheet member 53, among the sheets 12, the front end portions of which are on the sheet member 53, the uppermost sheet 12*a* is pressed on the sheet feeding roller 51 as shown in FIG. 4A, and then the feeding of the uppermost sheet 12*a* is started by the sheet feeding roller 51. Thereafter, although the sheet taking-up shaft 71 would be rotated continuously to take up the sheet member 53, no taking-up allowance is left when the uppermost sheet 12*a* has been brought into contact with the sheet feeding roller 51. Therefore, when the sheet taking-up shaft 71 has further rotated in such a state, torque increases. When the torque has exceeded a certain value (a limit value), the torque limiter 72 starts idle running. Note that, an abutment pressure generated between the sheet feeding roller 51 and the sheet 12*a* at that time depends on the torque of the torque limiter 72 and a feeding force exerted on the sheet member 53 by the sheet feeding roller 51.

Next, when the sheet feeding roller 51 has rotated further, the front end of the uppermost sheet 12*a* sent by the sheet feeding roller 51 comes into contact with the sheet member 53, following which the uppermost sheet 12*a* is fed along the sheet member 53, and then between the sheet feeding roller 51 and the sheet member 53. At that time, the feeding force generated by the rotation of the sheet feeding roller 51 is also transferred to the sheets 12 under the uppermost sheet 12*a* by friction between the sheets 12 stacked in the sheet tray 55. However, since the abutment pressure between the sheet feeding roller 51 and the uppermost sheet 12*a* is optimally set by the torque limiter 72, only the uppermost sheet 12*a* is separated from the other sheets 12 while being curved along the sheet member 53, and fed upward.

Figure 5A:
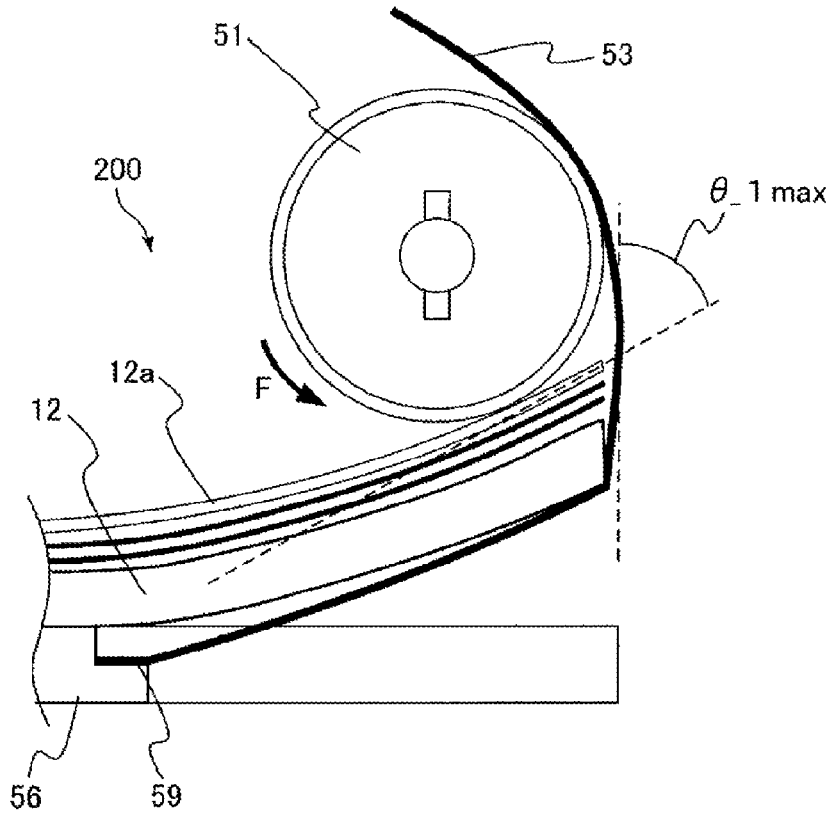
FIGS. 5A and 5B are each an explanatory drawing of an abutment pressure between a sheet and the sheet feeding roller of the sheet feeding device according to the first embodiment.
Figure 5B:
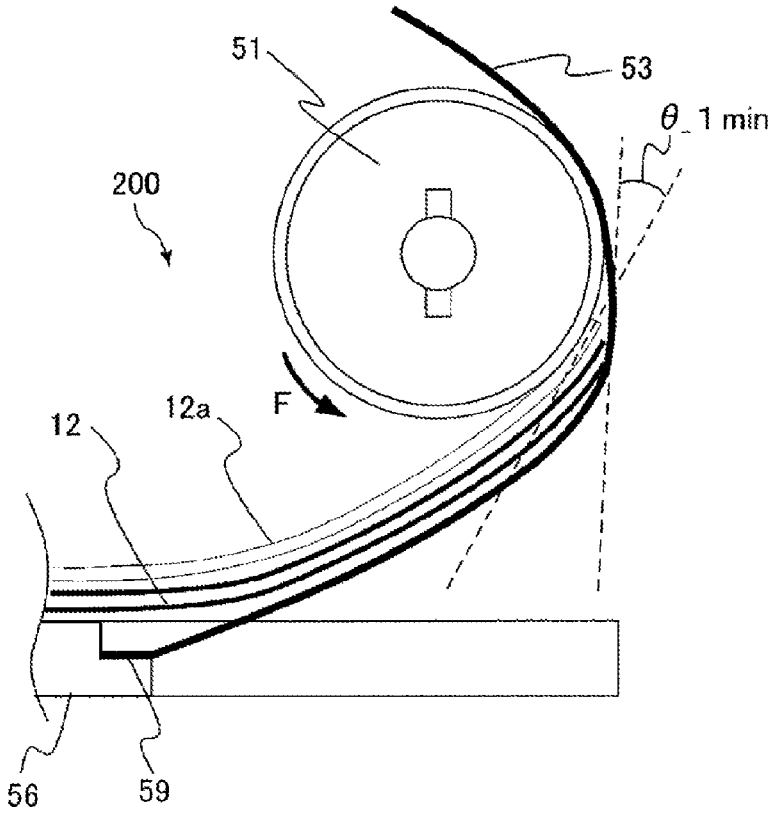

Note here that, the optimally set abutment pressure will now be described with reference to FIGS. 5A and 5B. FIG. 5A illustrates a state in which sheets 12 are fully loaded in the sheet tray 51 and the uppermost sheet 12*a* is pressed on the sheet feeding roller 51. As shown in FIG. 5A, the sheet 12*a* to which the feeding force has been applied impinges on the sheet member 53 at an impingement angle of θ_1 max. FIG. 5B illustrates a state in which few sheets 12 are put in the sheet tray 55 and the uppermost sheet 12*a* is pressed on the sheet feeding roller 51. In this case, the sheet 12*a* to which the feeding force has been applied impinges on the sheet member 53 at an impingement angle of θ_1 min.

At that time, the sheet 12 receives drag against the feeding force from the sheet member 53 due to the impingement; however, the abutment pressure between the sheet feeding roller 51 and the sheets 12 is set such that only the feeding force applied to the uppermost sheet 12*a* exceeds the drag and that the other sheets 12 remain as they are. Therefore, the uppermost sheet 12*a* is separated from the other sheets 12, and fed upward.

Figure 4B:
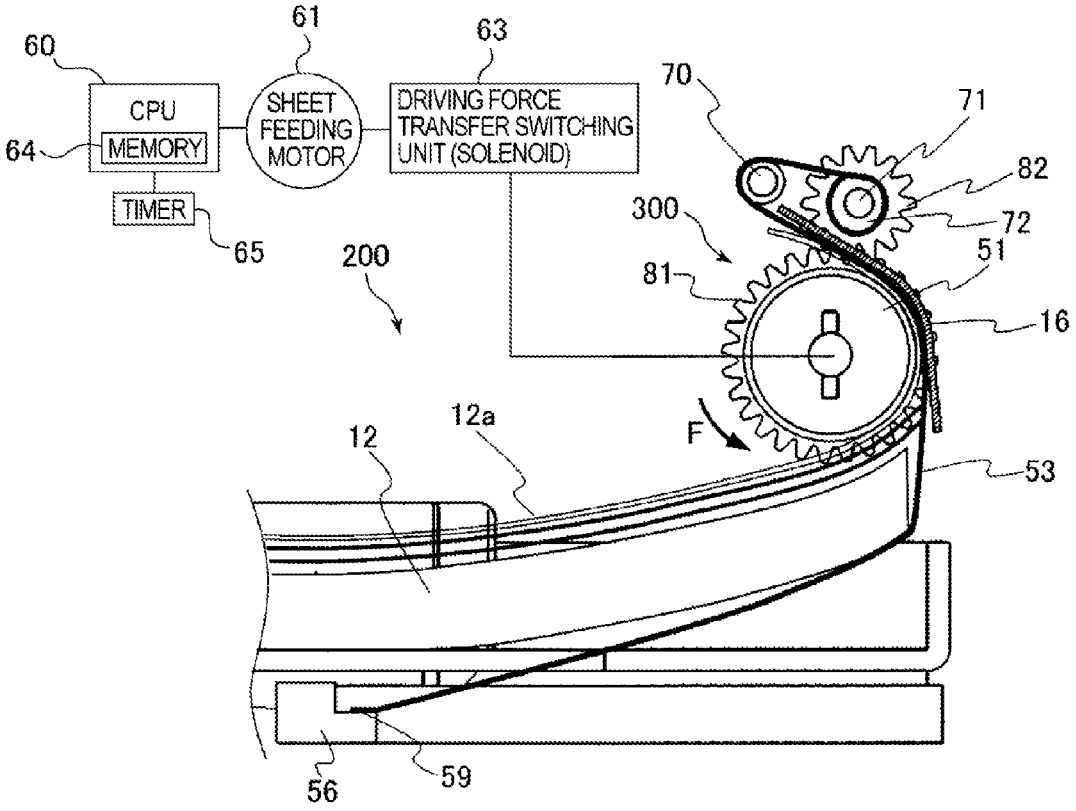

When the sheet feeding roller 51 has rotated further after the separation by the sheet feeding roller 51 at which the abutment pressure has been set like this, the uppermost sheet 12*a* reaches a nip portion at which the sheet feeding roller 51 and the sheet member 53 are in contact with each other. Thereafter, the uppermost sheet 12*a* passes through the nip portion between the sheet feeding roller 51 and the sheet member 53, and is sent to the resist roller 15 of FIG. 1 by using the sheet member 53 as a feeding guide, that is, by being guided by the sheet member 53 as shown in FIG. 4B.

At a point in time when the uppermost sheet 12*a* has reached the resist roller 15, the solenoid 63 is turned off, and the transfer of the driving force from the sheet feeding motor 61 to the sheet feeding roller 51 is halted; however, even when the transfer of the driving force from the sheet feeding motor 61 has been halted like this, the sheet feeding roller 51 drags (runs idle) by the movement of the uppermost sheet 12*a* while the uppermost sheet 12*a* is in contact with the sheet feeding roller 51.

Figure 6:
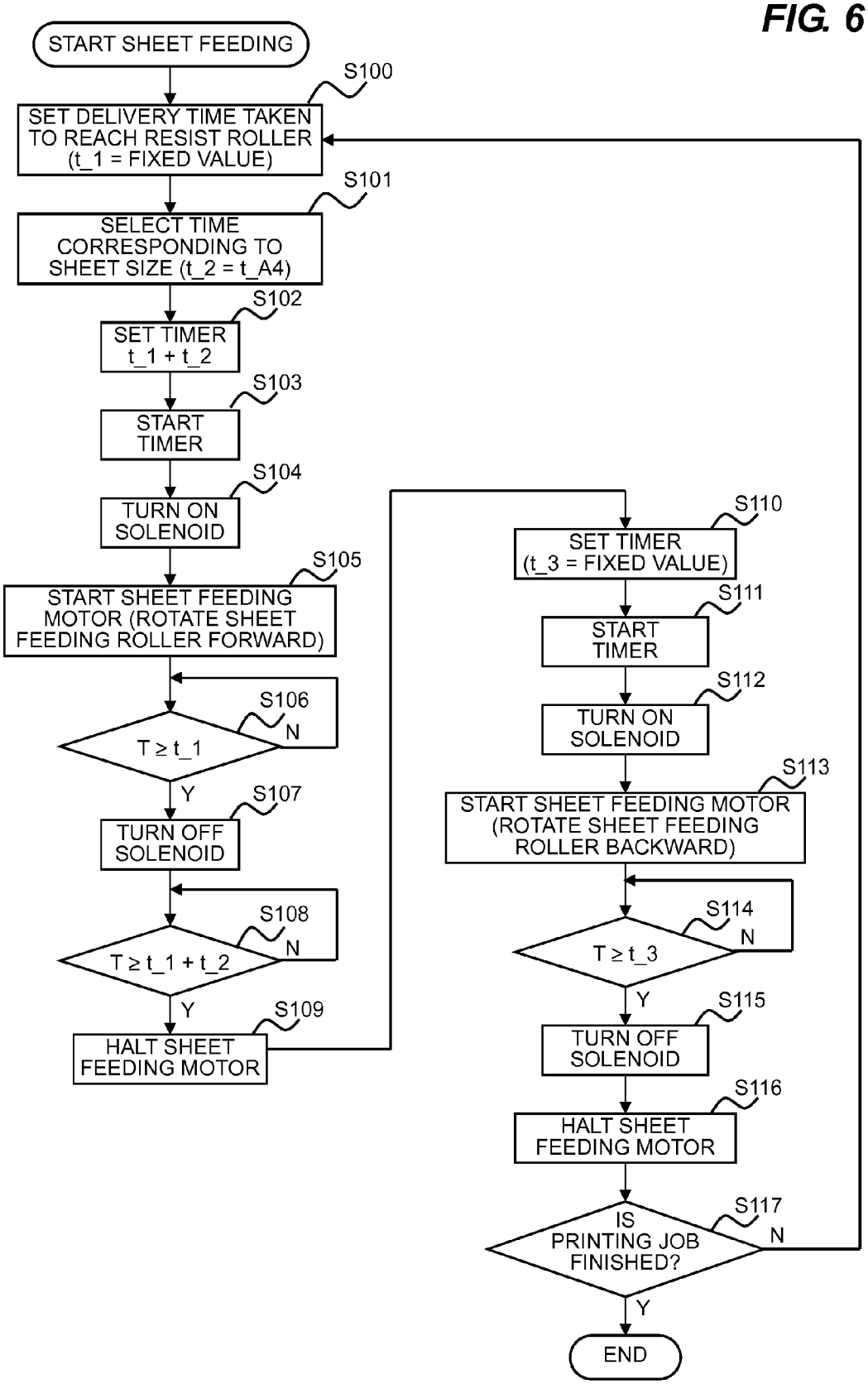
FIG. 6 is a flowchart of the sheet feeding operation of the sheet feeding device according to the first embodiment.

Next, the control of the sheet feeding operation of the sheet feeding device 200 will now be described with reference to a flowchart of FIG. 6 and a timing chart of FIG. 7. To begin with, before the start of the driving of the sheet feeding motor 61, the CPU 60 sets a sufficient time for the front end of the individual sheets 12 to reach the resist roller 15, i.e., sets a delivery time (a fixed value) t1 taken to deliver each sheet 12 to the resist roller 15 (step S100). Note that, a delivery time t1 can be set as a sufficient time for the front end of a sheet to reach the resist roller 15 after the driving of the sheet feeding motor 61 without regard to the size of the sheet.

Then a rotation time (a duration in time) t2 for the sheet feeding motor 61 corresponding to the sheet size is selected from the data table preloaded in the memory 64 in the CPU 60 (step S101). In the data table are presented rotation times for the sheet feeding motor 61 necessary for the back ends of various-size sheets to pass through the nip portion between the sheet feeding roller 51 and the sheet member 53. For example, in cases where A4-size sheets are used, a rotation time tA4 for the sheet feeding motor 61 is selected for reasons of necessity for the back end of each sheet to pass through the nip portion between the sheet feeding roller 51 and the sheet member 53. Therefore, to feed the sheets 12, the timer 65 is set for a rotation time (t1+t2) for the sheet feeding motor 61 (step S102).

Then the timer 65 is started up (step S103), and the solenoid 63 is turned on (step S104), following which the sheet feeding motor 61 is started up (step S105). Since the sheet feeding motor 61 rotates forward at that time, the sheet feeding roller 51 also rotates forward. Thereafter, the timer 65 measures elapsed time based on a count by an internal clock. When the sheet 12 has been delivered to the resist roller 15 and the measured time T exceeds or equates with the delivery time t1 having been taken to deliver the sheet 12 to the resist roller 15 (T≥t1) (Y in step S106), the solenoid is turned off to halt the driving force transfer (step S107). Note that, even when the driving force transfer has been halted like this, the sheet feeding roller 51 does not interfere with the conveyance of the sheet 12 by the resist roller 15. This is because the sheet feeding roller 51 further rotates by the movement of the sheet 12.

When the back end of the sheet 12 has come out of the nip portion between the sheet feeding roller 51 and the sheet member 53 and the measured time T exceeds or equates with the rotation time (t1+t2) for the sheet feeding motor 61 (T≥t1+t2) (Y in step S108), the sheet feeding motor 61 is halted (step S109), whereby the feeding of the first sheet 12 is finished.

Figure 7:
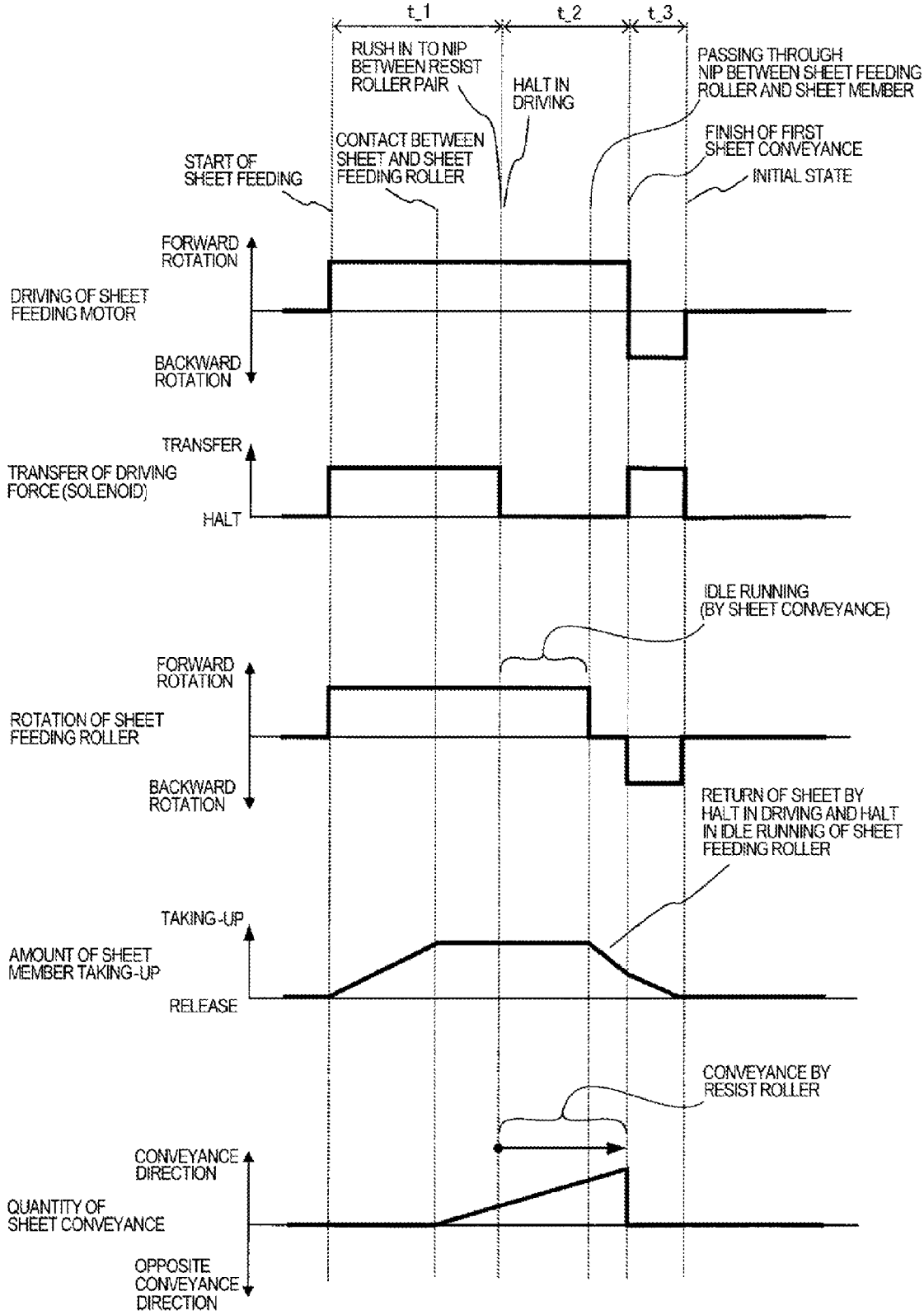
FIG. 7 is a timing chart of the sheet feeding operation of the sheet feeding device according to the first embodiment.

As shown in FIG. 7, until the sheet 12 comes out of the nip portion between the sheet feeding roller 51 and the sheet member 53, the sheet taking-up shaft 71 can be rotated in conjunction with the rotation of the sheet feeding roller 51 brought by the movement of the sheet 12, and thus the sheet member 53 can be held taken up. At a point in time when the sheet 12 has come out of the nip portion between the sheet feeding roller 51 and the sheet member 53 after that, the rotation in the feeding direction (the forward rotation) of the sheet feeding roller 51 stops.

On the other hand, when the forward rotation of the sheet feeding roller 51 has stopped, the sheet taking-up shaft 71 becomes free to rotate because the driving force transfer has been halted by the turning-off of the solenoid 63, whereby the force by which the sheet member 53 is held taken up is lost. As a result, the sheets 12 and the sheet member 53 naturally go down under their own weight in general. However, even when the sheet taking-up shaft 71 is in the state of being free to rotate like this, the sheets 12 and the sheet member 53 sometimes do not go down naturally. This is because a load heavier than the weight of the sheet 12 itself and the weight of the sheet member 53 itself is applied depending on the structures of sheet feeding devices.

To deal with such a case, the solenoid 63 is turned on and the sheet feeding motor 61 is rotated backward to rotate the sheet feeding roller 51 backward, i.e., in the direction of the arrow R shown in FIG. 3A, in this embodiment. Specifically, after the feeding of the first sheet has been finished, the timer 65 is set for a backward rotation time t3 (a fixed value) (step S110), after which the timer 65 is started (step S111). Note that, the backward rotation time t3 is set as a fixed time period without regard to sheet size: specifically, the backward rotation time t3 is set so that the sheet member 53, taken up by a take-up length predetermined according to the arrangement of the components, can be returned to its initial state shown in FIG. 3A including a margin.

Then the solenoid 63 is turned on (step S112), following which the backward rotation of the sheet feeding motor 61 is started (step S113). Since the solenoid 63 is turned on at that time, the sheet feeding roller 51 rotates backward, after which elapsed time is measured based on a count by the internal clock. When the measured time t exceeds or equates with the backward rotation time t3 (t≥t3) (Y in step S114), the solenoid 63 is turned off (step S115), and then the sheet feeding motor 61 is stopped (step S116). As a result of such control, that is, by performing such an initialization sequence, the sheet member 53 can be released and returned to the initial state shown in FIG. 3A. By performing the initialization sequence, the sheet 12 can be returned to its initial position, and the stable feeding of the next sheet 12 can be performed. Thereafter, the above job is repeated until printing job is finished (Y in step S117).

In this embodiment, at the time of sheet feeding, the sheet member 53 is pulled up to press a sheet on the sheet feeding roller 51, and then the sheet is fed along the sheet member 53 as described above. By using such a mechanism, it is unnecessary to provide a bending forming space necessary in a method of pulling back a sheet to the upstream side of a sheet feeding direction once and then feeding the sheet to the downstream side, and therefore a further downsized sheet feeding device can be implemented.

Moreover, in this embodiment, unlike a method in which sheets are stored in a sheet tray with the sheets curved, sheets do not curve at all times, whereby failure in sheet feeding is prevented to a large extent, and degradation in quality of printed matter can also be prevented. Furthermore, there is no step portion, such as a junction portion for a conveyance guide, in the conveyance path along which sheets are picked up and separated, and thus the occurrence of a paper jam can also be reduced.

That is, in this embodiment, at the time of sheet feeding, the sheet member 53 is pulled up to press a sheet on the sheet feeding roller 51, and then the sheet is fed along the sheet member 53, whereby the occurrence of failure in sheet feeding and degradation in quality of printed matter can be prevented with the downsizing of the sheet feeding device 200 achieved. Note that, in this embodiment, after a sheet has reached the resist roller 15, the solenoid 63 is turned off to halt the driving force transfer to the sheet feeding roller 51, and thus the sheet feeding roller 51 runs idle; however, the sheet feeding roller 51 can be made to run idle without turning off the solenoid 63 or using other means by making the conveyance speed of the resist roller 15 higher than the conveyance speed of the sheet feeding roller 51 through the provision of a one-way clutch along the driving shaft 51*a* of the sheet feeding roller 51.

Next, a second embodiment of the present invention will now be described. FIGS. 5A and 5B illustrate that when the sheet 12 impinges on the sheet member 53 by the rotational driving of the sheet feeding roller 51, the impingement angle changes according to the quantity of the sheets 12 remaining in the sheet tray 55. As shown in FIG. 5A, at the time when the sheets 12 are fully loaded in the sheet tray 55, since the hardness (the stiffness) of the bundle of the sheets 12 is high even in a state of being pulled up by the sheet member 53, the curvature of the uppermost sheet 12*a* is small, and hence the uppermost sheet 12*a* impinges on the sheet member 53 at an impingement angle of θ_1 max.

In contrast, as shown in FIG. 5B, as the quantity of the loaded sheets 12 becomes small and the hardness (the stiffness) of the bundle of the sheets 12 becomes low, the uppermost sheet 12*a* is pressed on the sheet feeding roller 51 while being curved considerably along the sheet member 53. At that time, the uppermost sheet 12*a* impinges on the sheet member 53 at the impingement angle of θ_1 min, but this angle is small when compared with the impingement angle of θ_1 max at the time of the full loading. For the sheet pulling-up unit 300 that pulls up the sheets 12 in this way, in the case where a portion on which the sheets 12 are stacked is made of a flexible material as in the case of the sheet member 53, the impingement angle of the sheet 12 with respect to the sheet member 53 changes considerably according to the quantity of the loaded sheets 12.

The impingement angle of the sheets 12 with respect to the sheet member 53 is an important parameter at the time when the sheets 12 are separated one by one. That is, when the impingement angle is too large, it becomes necessary to use a strong force for the feeding, and nonfeeding of sheets and folding of the end portions of sheets tend to occur. On the contrary, when the impingement angle is small, the drag at the time of the impingement of the sheet 12 on the sheet member 53 becomes low, whereby some of the sheets 12 other than the uppermost sheet 12*a* are prone to be fed, i.e., multifeeding of the sheets 12 tends to occur. Because of this, to exhibit high sheet feeding performance, it is preferable that the impingement angle fall within a fixed range so that the impingement angle of the sheets 12 with respect to the sheet member 53 does not change significantly. Hence, in this embodiment, the change in the impingement angle at the time of the impingement of the sheets 12 on the sheet member 53 is made small.

Figure 8:
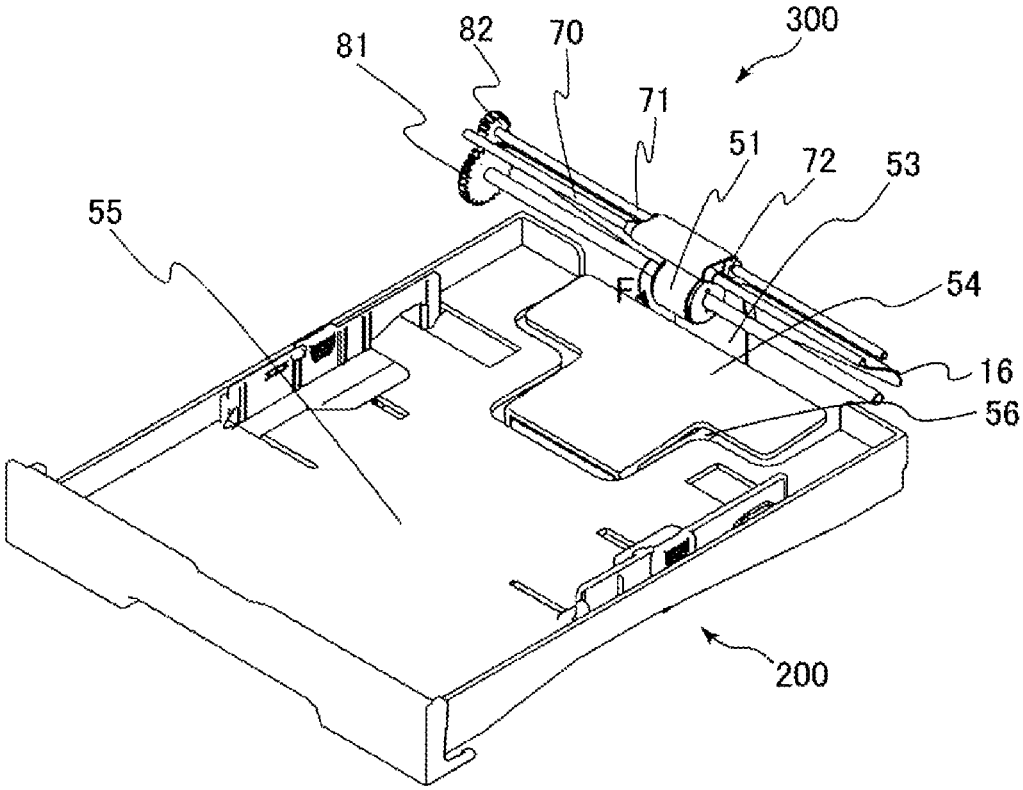
FIG. 8 is a first explanatory drawing of the structure of a sheet feeding device according to a second embodiment of the invention.
Figure 9:
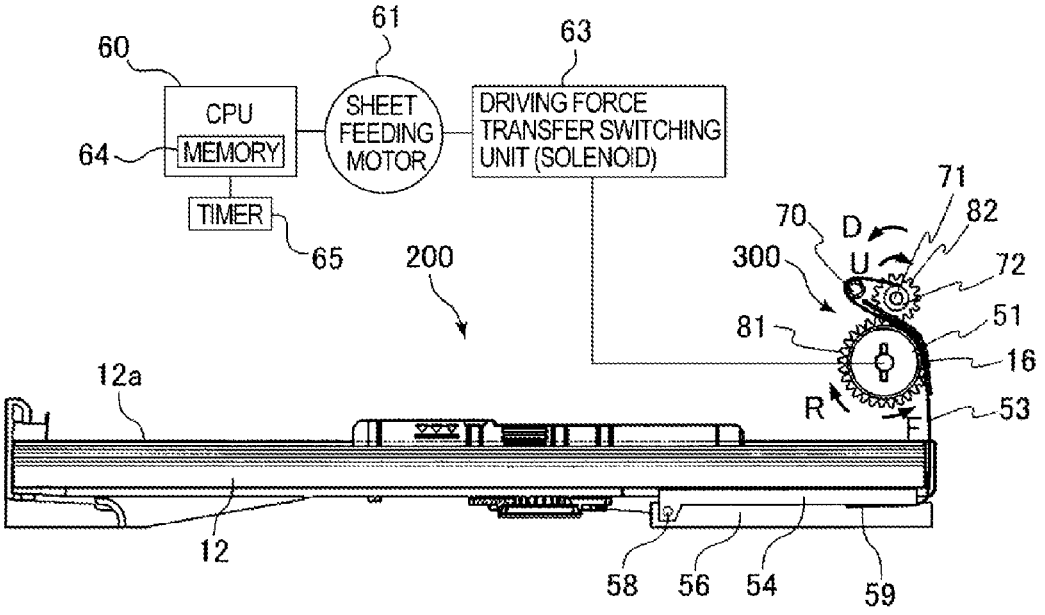
FIG. 9 is a second explanatory drawing of the structure of the sheet feeding device according to the second embodiment.

FIGS. 8 and 9 illustrate the structure of the sheet feeding device 200 according to the second embodiment. Note that, in FIGS. 8 and 9, the same reference numerals as those in FIGS. 2A, 2B, 3A, and 3B denote the same or similar components as those of FIGS. 2A, 2B, 3A, and 3B. As shown in FIGS. 8 and 9, a sheet pulling-up plate 54 is provided to the sheet fixing member 56 in a manner that is swingable up and down to hold up the front end portions of sheets 12 from below. Examples of a material for the sheet pulling-up plate 54 include various plastic materials and metallic plate materials such as a zinc-coated steel plate. Further, the sheet pulling-up plate 54 as a swinging member is provided with a fitting shaft 58 at its back end portion, and is held by the sheet fixing member 56 via the fitting shaft 58 in a manner that swings freely.

At the front end portion of the sheet pulling-up plate 54, the sheet member joining portion 59 is provided. To the sheet member joining portion 59, the low end of the sheet member 53 is fixed. That is, as members to pull up the sheets 12 to the side of the sheet feeding roller 51, the sheet pulling-up unit 300 according to this embodiment includes the sheet pulling-up plate 54 of a stiff plate material that supports the sheets 12 in addition to the sheet member 53 of a flexible material.

Next, sheet feeding operation of the sheet feeding device 200 having such a structure will now be described. Before the start of the sheet feeding operation, the sheet feeding roller 51 and the sheets 12 are in a state of being out of contact with each other as shown in FIG. 9. After the reception of a command to start the feeding of the sheets 12 from the host apparatus or the like, the CPU 60 rotationally drives the sheet feeding motor 61 and turns on the solenoid 63. As a result, a driving force is transferred to the sheet feeding roller 51, whereby the sheet feeding roller 51 starts to rotate in the direction of the arrow F.

Figure 10A:
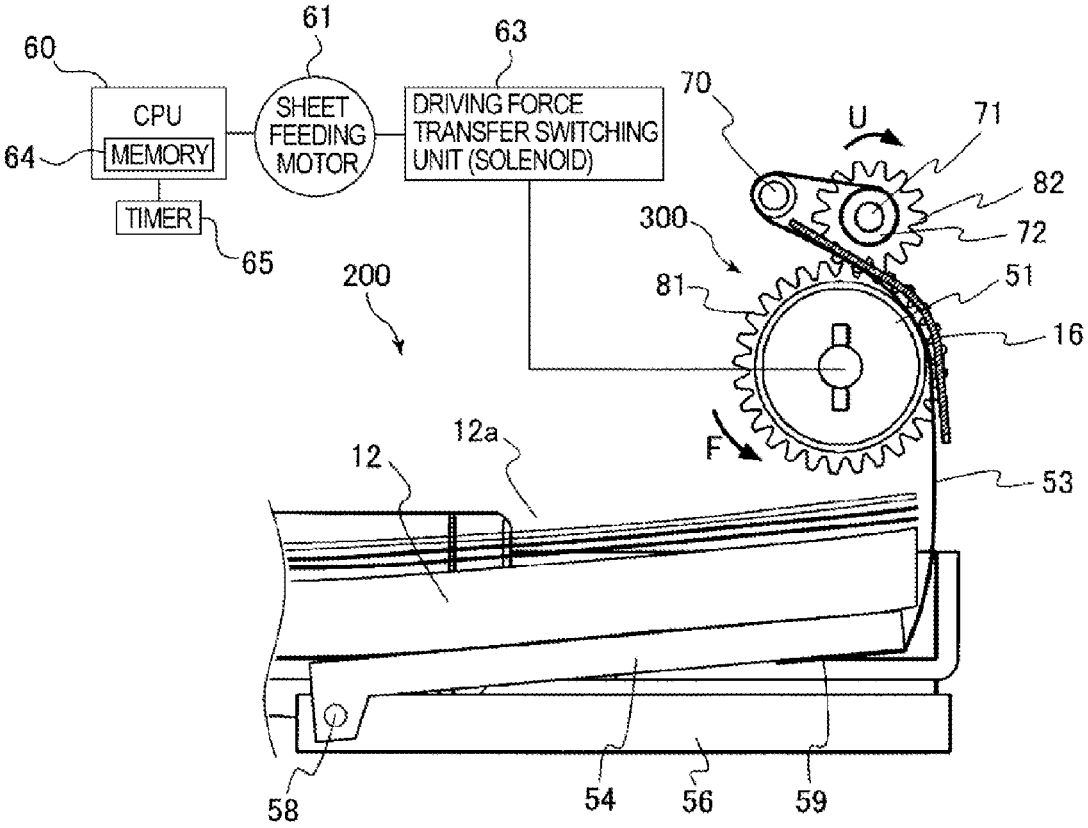
FIGS. 10A and 10B are each a first explanatory drawing of sheet feeding operation of the sheet feeding device according to the second embodiment.
Figure 10B:
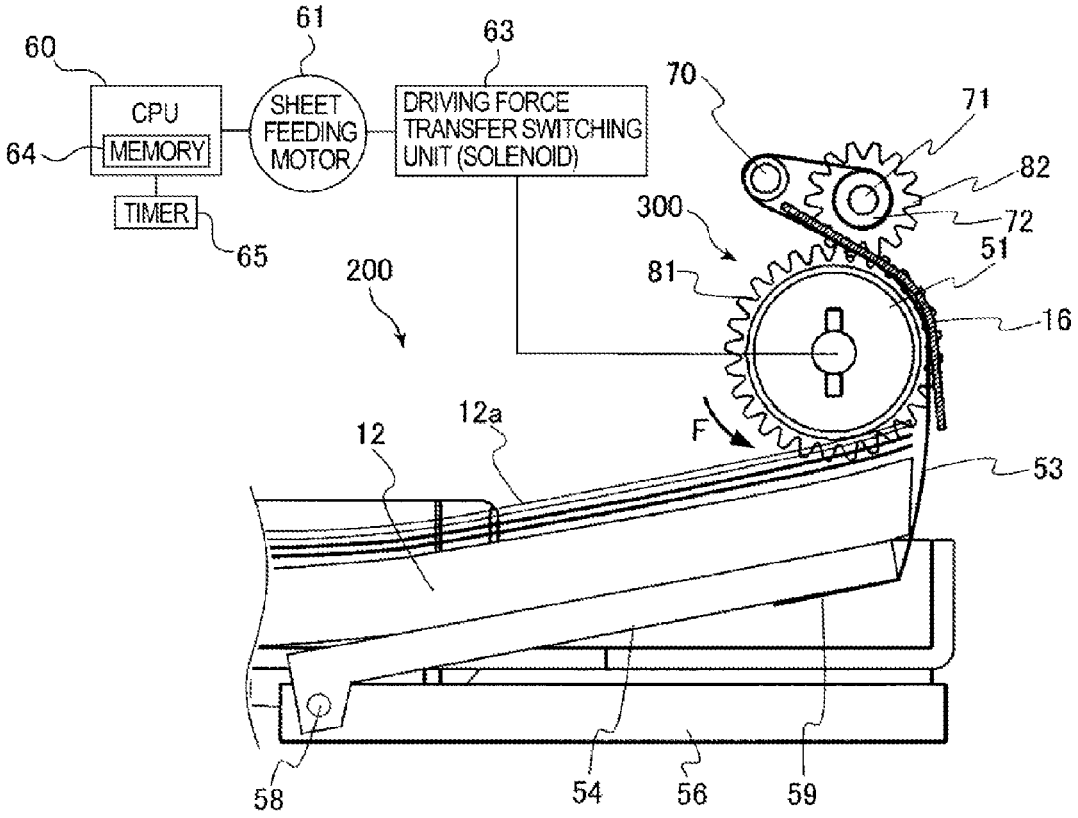

The rotational driving force of the sheet feeding motor 61 is transferred from the sheet feeding roller gear 81 to the taking-up gear 82. Then the sheet taking-up shaft 71 rotates in the direction of the arrow U, whereby the sheet member 53 is taken up by the sheet taking-up shaft 71. When the sheet member 53 is taken up, the sheet pulling-up plate 54 swings upward along with the sheet member 53 as shown in FIG. 10A, following which the sheet 12 is pressed on the sheet feeding roller 51 as shown in FIG. 10B. Thereafter, the uppermost sheet 12*a* is fed by the sheet feeding roller 51.

Figure 11:
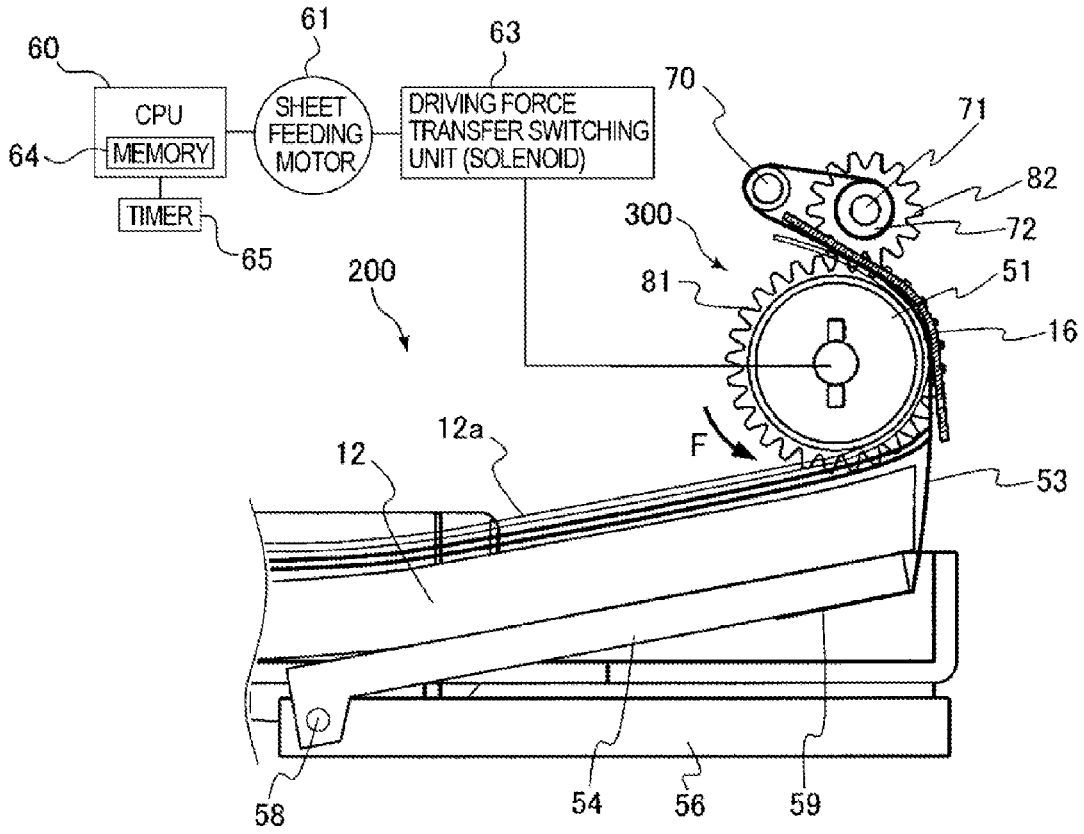
FIG. 11 is a second explanatory drawing of the sheet feeding operation of the sheet feeding device according to the second embodiment.

After the sheet feeding roller 51 has further rotated, the front end of the uppermost sheet 12*a* comes in contact with the sheet member 53. Then the uppermost sheet 12*a* is fed along the sheet member 53, and then between the sheet feeding roller 51 and the sheet member 53 as shown in FIG. 11. At that time, a feeding force generated by the rotation of the sheet feeding roller 51 is also transferred to the sheets 12 other than the uppermost sheet 12*a* by friction between the sheets 12 stacked in the sheet tray 55. However, since an abutment force between the sheet feeding roller 51 and the sheets 12 is optimally set by the torque limiter 72, only the uppermost sheet 12*a* is separated from the other sheets 12 while being curved along the sheet member 53, and fed upward.

Figure 12A:
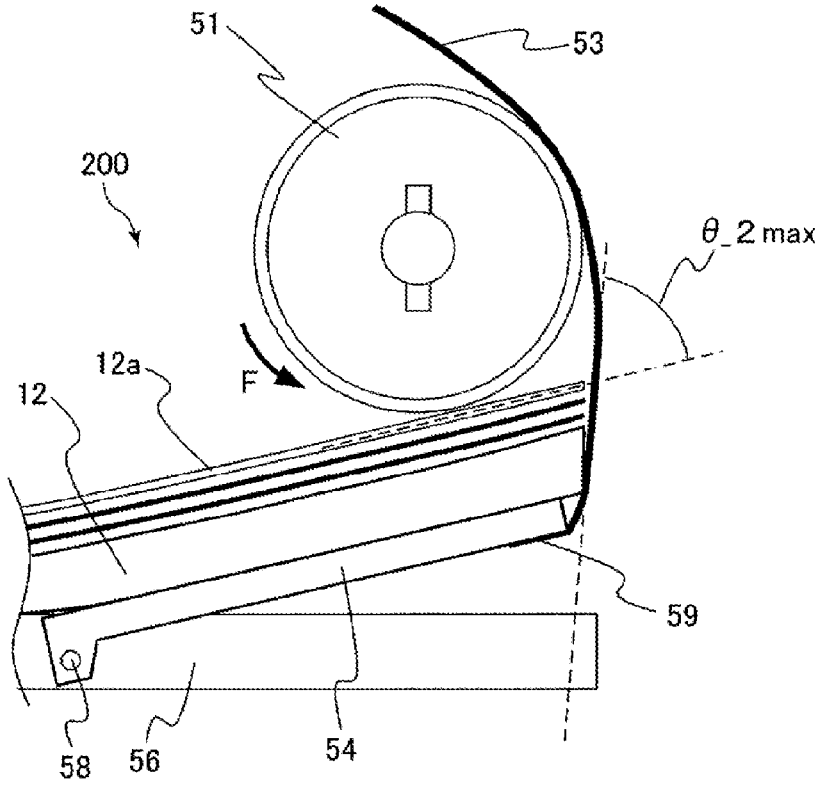
FIGS. 12A and 12B are explanatory drawings of a change in an impingement angle of a sheet with respect to the sheet member of the sheet feeding device according to the second embodiment.
Figure 12B:
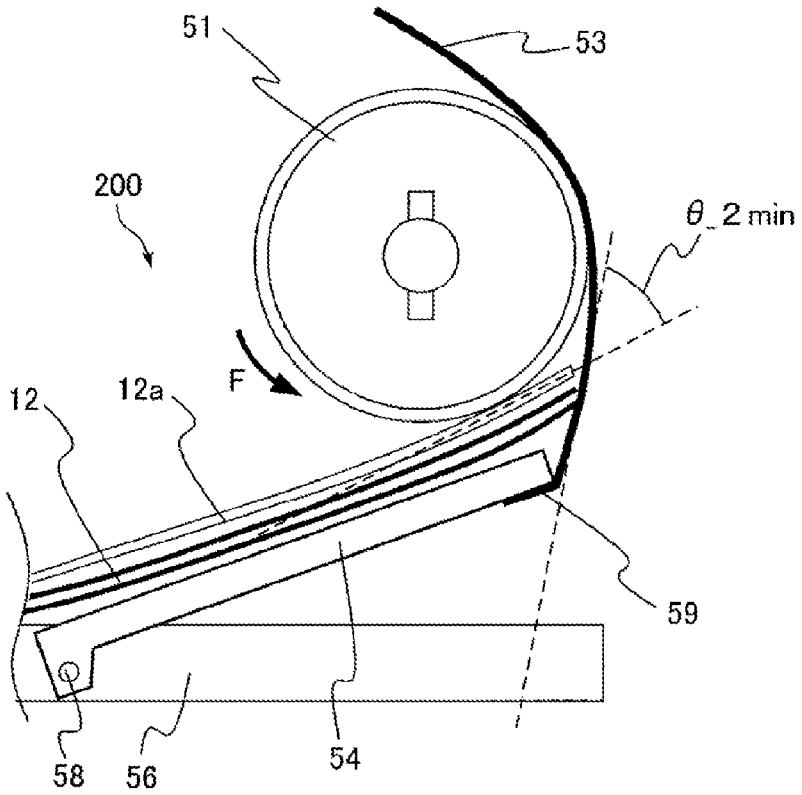

FIGS. 12A and 12B illustrate a change in an impingement angle of the sheets 12 with respect to the sheet member 53 in the second embodiment. FIG. 12A illustrates a state in which the sheets 12 are fully loaded in the sheet tray 55: in this case, the impingement angle θ of the sheet 12 with respect to the sheet member 53 is represented as θ_2 max. FIG. 12B illustrates a state in which the quantity of the loaded sheets 12 has become small: in this case, the impingement angle θ of the sheet 12 with respect to the sheet member 53 is represented as θ_2 min.

In this embodiment, since the sheets 12 are held up by the sheet pulling-up plate 54, the curvature of the sheet 12 at an abutment portion at which abutment on the sheet feeding roller 51 is effected shown in FIG. 12B is small compared with the curvature shown in FIG. 5B, and the impingement angle is made large. That is, the relationship between a change in impingement angle θ of the sheet 12 with respect to the sheet member 53 shown in FIGS. 5A and 5B (θ_1 max−θ_1 min) and a change in impingement angle θ shown in FIGS. 12A and 12B (θ_2 max−θ_2 min) is expressed by the following inequality.

$$\theta_1\ \max-\theta_1\ \min>\theta_2\ \max-\theta_2\ \min$$

From the above, it can be seen that the change in the impingement angle is reduced by using the mechanism according to the second embodiment.

As described above, in the second embodiment, by holding up sheets through the use of the sheet pulling-up plate 54 formed of a stiff material, the amount of the change in the angle at which the sheets impinge on the sheet member 53 is reduced even when the quantity of the sheets stored in the sheet tray 55 has varied. Therefore, the sheets in the sheet tray 55 can be separated and fed reliably to the last sheet. Further, in the second embodiment as well, a reliable sheet feeding device that does not degrade the quality of printed matter and rarely causes paper jams and multifeeding can be provided with further downsizing implemented.

Next, a third embodiment according to the present invention will now be described. In the first and second embodiments described above, by pulling up the sheet member 53 while rotating the sheet feeding roller 51, the sheet 12 is pressed on the sheet feeding roller 51. In the above method, there are cases where a sheet feeding pressure does not rise sufficiently and the transfer of the feeding force to the sheet 12 is therefore started using such a low sheet feeding pressure. In that case, biased impingement of the sheet 12 on the sheet feeding roller 51 or the like occurs, and thus a sheet feeding failure, i.e., the skew feeding of the sheet 12 may occur.

Therefore, to exhibit higher sheet feeding performance, it is preferable to start the driving of the sheet feeding roller 51 after the sheet feeding pressure has reached a predetermined value sufficiently. Hence, in the third embodiment, the driving of the sheet feeding roller 51 is started after the sheet feeding pressure has reached the predetermined value sufficiently like this.

Figure 13:
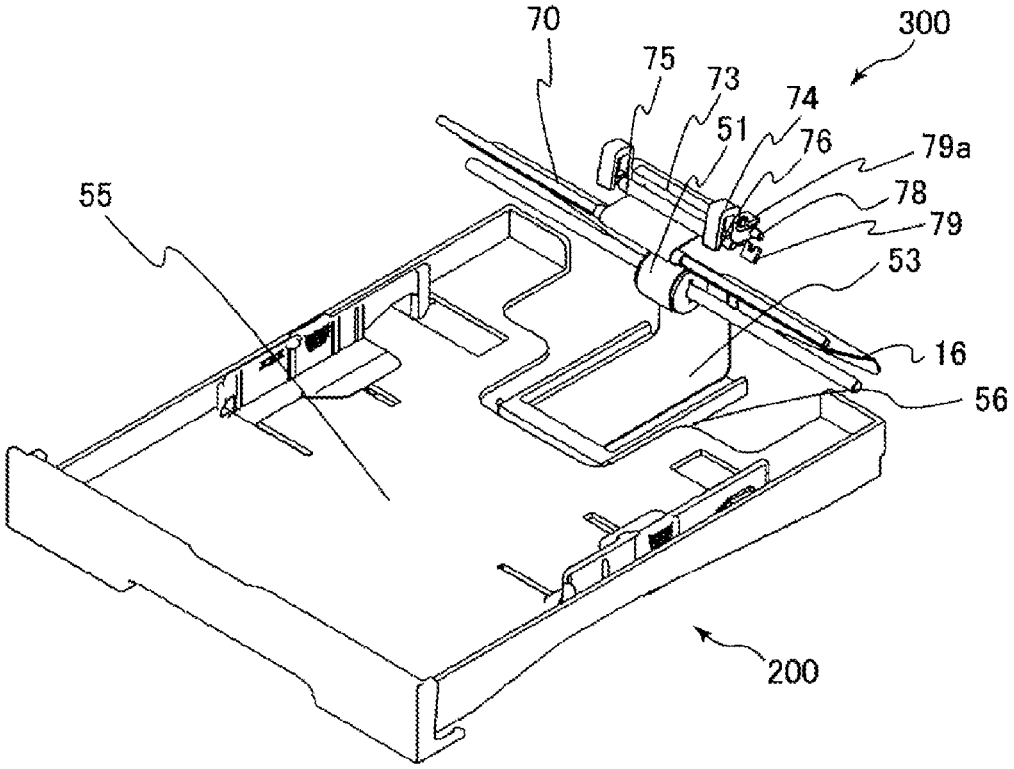
FIG. 13 is a first explanatory drawing of the structure of a sheet feeding device according to a third embodiment of the invention.
Figure 14A:
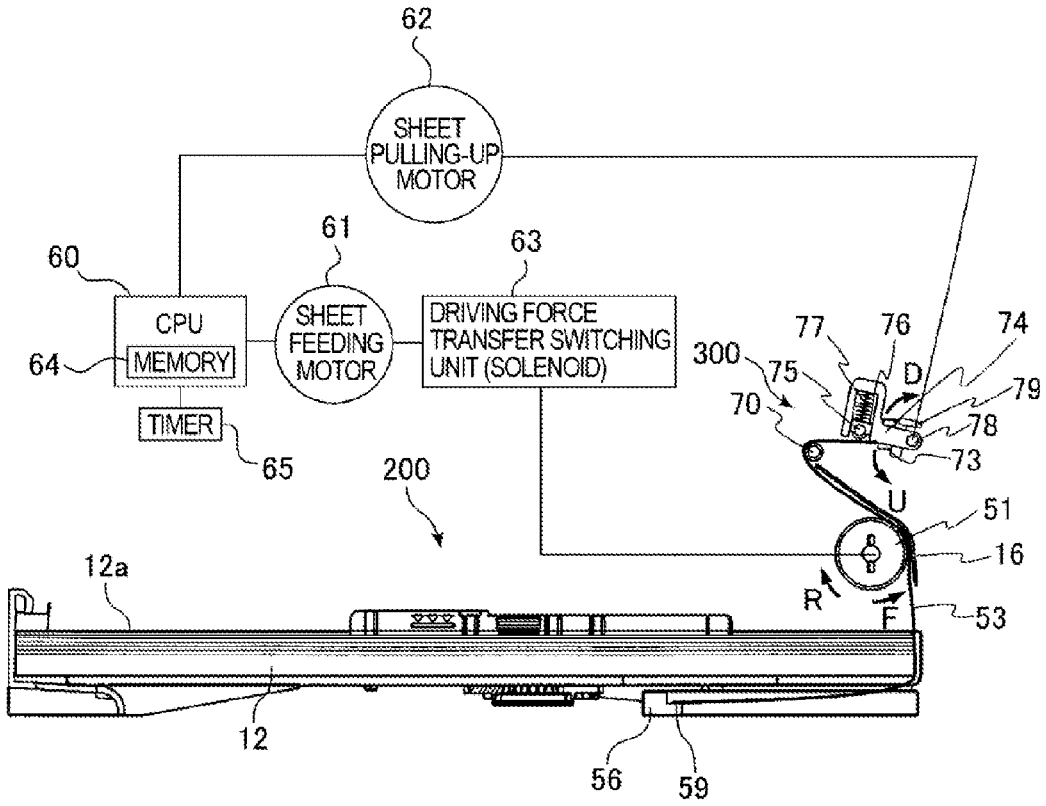
FIGS. 14A and 14B are each a second explanatory drawing of the structure of the sheet feeding device according to the third embodiment.
Figure 14B:
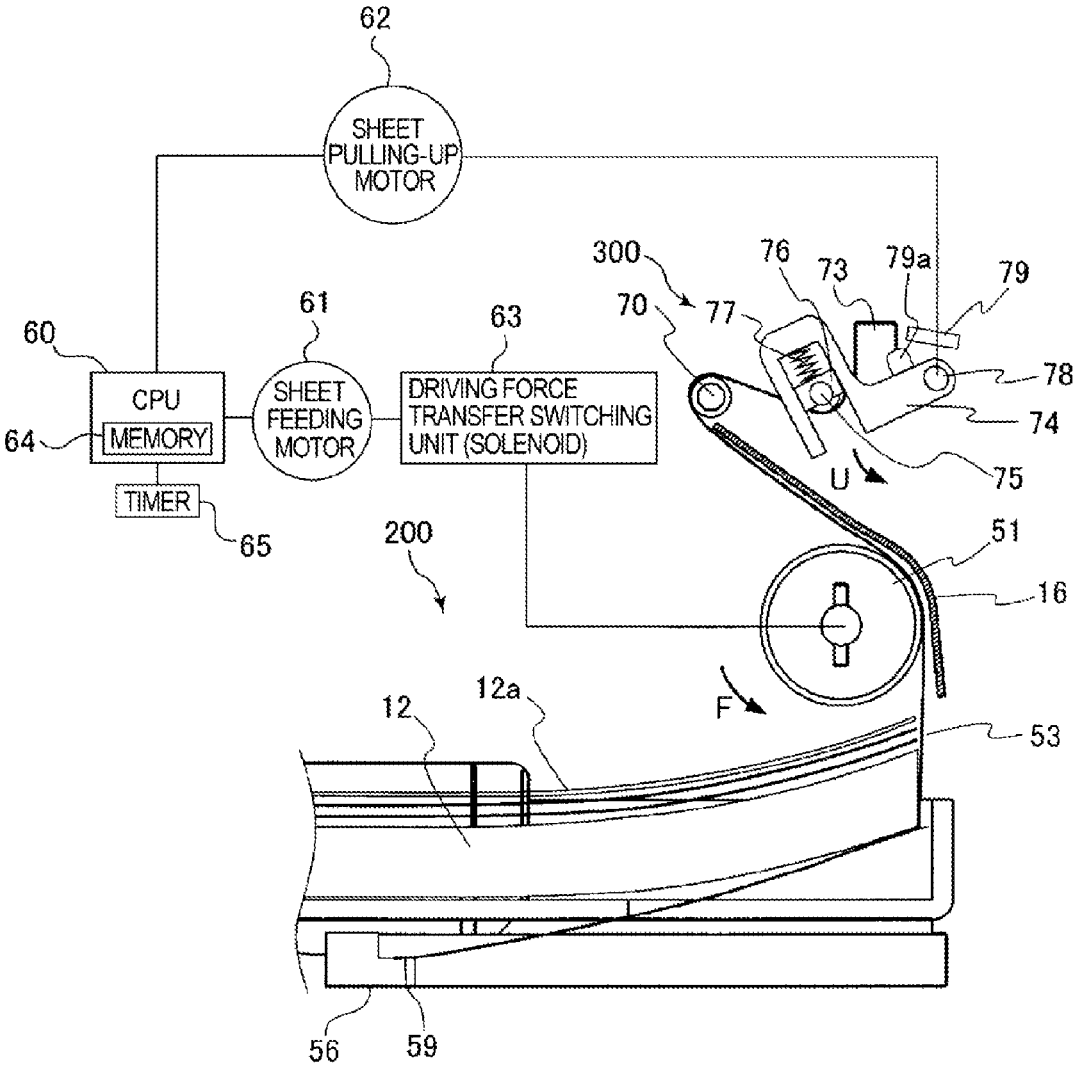

FIGS. 13, 14A, and 14B illustrate a sheet feeding device 200 according to the third embodiment. Note that, in FIGS. 13, 14A, and 14B, the same reference numerals as those in FIGS. 2A, 2B, 3A, and 3B denote the same or similar components as those of FIGS. 2A, 2B, 3A, and 3B.

As shown in FIGS. 13, 14A, and 14B, the printer body 100A is provided with a fixing portion 73. To the fixing portion 73, the high end portion of the sheet member 53 is fixed. A sheet pressing-down member 74 is a pressing member that pulls up the lower portion of the sheet member 53. The pulling up is performed by bending the sheet member 53 by the downward pressing of the sheet member 53 between the fixing portion 73 and the sheet running shaft 70 provided between the sheet feeding roller 51 and the fixing portion 73. The sheet pressing-down member 74 is provided to the printer body 100A in a manner that freely swings up and down around a lever spindle 78: the sheet pressing-down member 74 swings around the lever spindle 78 with a driving force of a sheet pulling-up motor 62 that runs as a driving portion. Further, the sheet pressing-down member 74 is provided with a sheet pressing-down rollable member 75 being in contact with the sheet member 53. The sheet pressing-down rollable member 75 is held by a rollable member bearing 76 at both ends of the rollable member 75. The rollable member bearing 76 is biased to the side of the sheet member 53 by a compression spring 77.

By swinging the sheet pressing-down member 74 downward, the upper portion of the sheet member 53, the high end of which is fixed to the fixing portion 73, is pressed down to obliquely below the sheet running shaft 70. By pressing down the upper portion of the sheet member 53 like this, the lower portion of the sheet member 53 is pulled up, and the sheet 12, the front end portion of which is held up by the sheet member 53, is pressed on the sheet feeding roller 51.

That is, in the sheet pulling-up unit 300 according to this embodiment, instead of taking up the sheet member 53, the sheet member 53 is bent downward by the sheet pressing-down member 74, for example, to pull up the sheet 12. Further, the sheet pressing-down member 74 is driven by the sheet pulling-up motor 62, i.e., the sheet feeding motor 51 and the sheet pressing-down member 74 are driven separately from each other.

The use of such a structure enables the free settings of the timings of contact and estrangement between the sheet 12 and the sheet feeding roller 51 and the timing of the rotational driving of the sheet feeding roller 51. Note that, in this embodiment, after the sheet 12 has been pressed on the sheet pressing roller 51 at a predetermined sheet feeding pressure by swinging down the sheet pressing-down member 74, the rotation of the sheet feeding roller 51 is started. Therefore, the rotation of the sheet feeding roller 51 can be started after the sheet feeding pressure has reached the predetermined value sufficiently, and higher sheet feeding performance can, therefore, be exhibited.

As shown in FIGS. 13, 14A, and 14B, the sheet pulling-up unit 300 includes a photosensor 79 and a light-shielding member 79*a* provided to the sheet pressing-down member 74. When the sheet pressing-down member 74 is at an initial position shown in FIG. 14A, the CPU 60 can detect that the sheet pressing-down member 74 is at the initial position by the shielding of the photosensor 79 from light by the light-shielding member 79*a*.

Next, sheet feeding operation of the sheet feeding device 200 according to the third embodiment will now be described. Before the start of the sheet feeding operation, the sheet feeding roller 51 and the sheets 12 are in a state of being out of contact with each other as shown in FIG. 14A. After the reception of a command to start the feeding of the sheets 12 from the host apparatus or the like, the CPU 60 rotationally drives the sheet feeding motor 61, and turns on the solenoid 63 to transfer a driving force to the sheet feeding roller 51. As a result, the sheet feeding roller 51 starts to rotate in the direction of the arrow F, and at the same time the sheet pressing-down member 74 is swung down as shown by the arrow U by rotating the sheet pulling-up motor 62, whereby the upper portion of the sheet member 53 is pressed down. When the upper portion of the sheet member 53 has been pressed down, the sheet member 53, together with the sheets 12, is pulled up toward the sheet feeding roller 51 because the low end portion of the sheet member 53 is joined to the sheet fixing member 56, whereby the sheet member 53 is pressed on the sheet feeding roller 51.

At the step of pressing the sheet member 53 on the sheet feeding roller 51 like this, a force for assisting with the taking up of the sheet member 53 is applied from the sheet feeding roller 51 to the sheet member 53. In addition, since the low end portion of the sheet member 53 is joined to the sheet fixing member 56, the apparent length of the sheet member 53 becomes short when the upper portion of the sheet member 53 has been pressed down. As a result, the sheet member 53 is pulled up, and thus the sheets 12 are pulled up in the direction of contact with the sheet feeding roller 51 as shown in FIG. 14B.

Figure 15A:
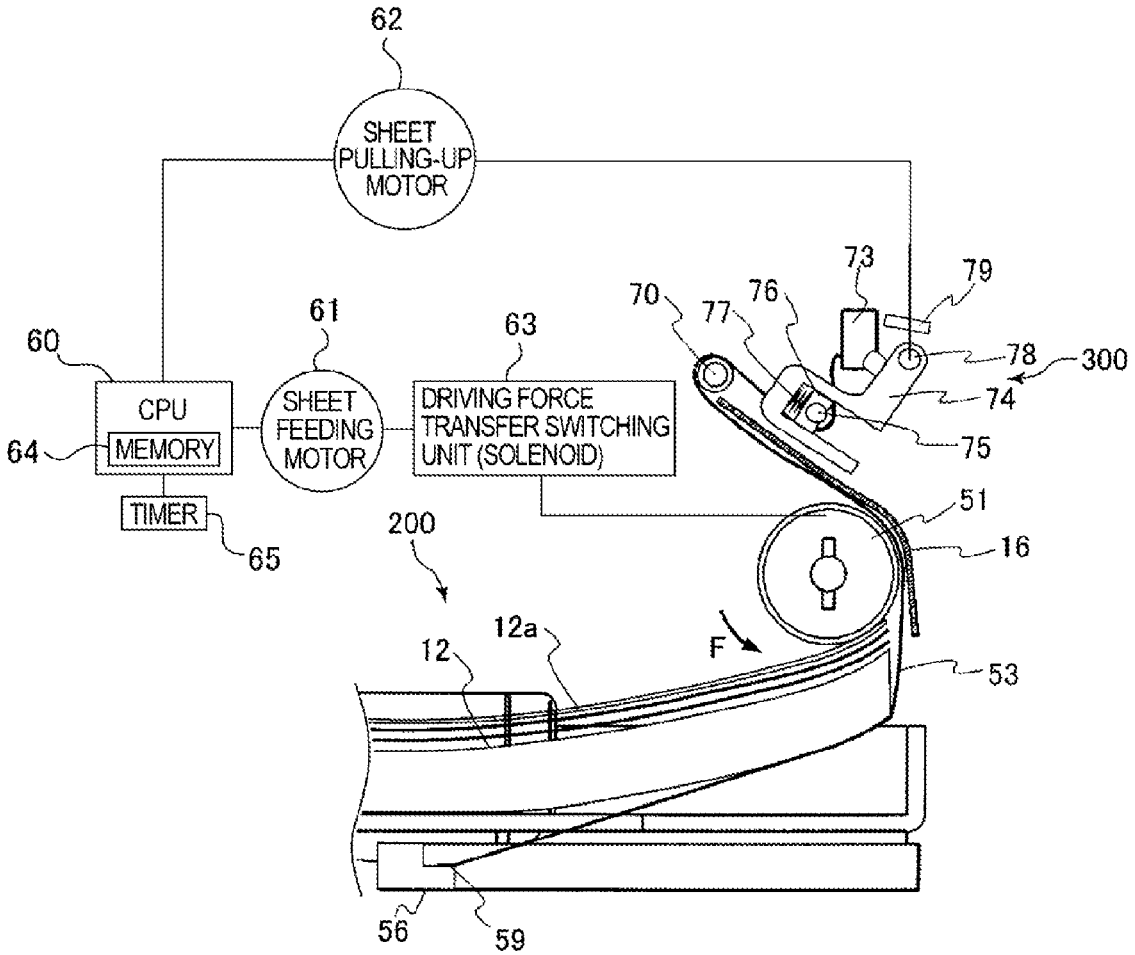
FIGS. 15A and 15B are explanatory drawings of sheet feeding operation of the sheet feeding device according to the third embodiment.

After further pressing down of the sheet member 53, of the sheets 12, the front end portions of which are held up by the sheet member 53, the uppermost sheet 12*a* is pressed on the sheet feeding roller 51 as shown in FIG. 15A, following which the feeding of the uppermost sheet 12*a* by the sheet feeding roller 15 is started. Note that, the sheet pulling-up motor 62 is designed to halt at a point in time when a predetermined load has been applied, and load torque with which the rotation is halted depends on driving voltage. Therefore, by adjusting a voltage to be applied to the sheet pulling-up motor 62, the sheet pulling-up motor 62 can be halted at the point in time when the predetermined load has been applied.

Hence, the CPU 60 is designed to apply a preset motor driving voltage to the sheet pulling-up motor 62 to generate the predetermined sheet feeding pressure. Therefore, the rotation of the sheet pulling-up motor 62 is halted at a point in time when a fixed load torque has been reached. Further, by adjusting the driving voltage for the sheet pulling-up motor 62 like this, the sheet pressing-down member 74 can be held swung until a fixed load is applied, whereby an abutment pressure between the sheet 12 and the sheet feeding roller 51 can be managed.

Figure 15B:
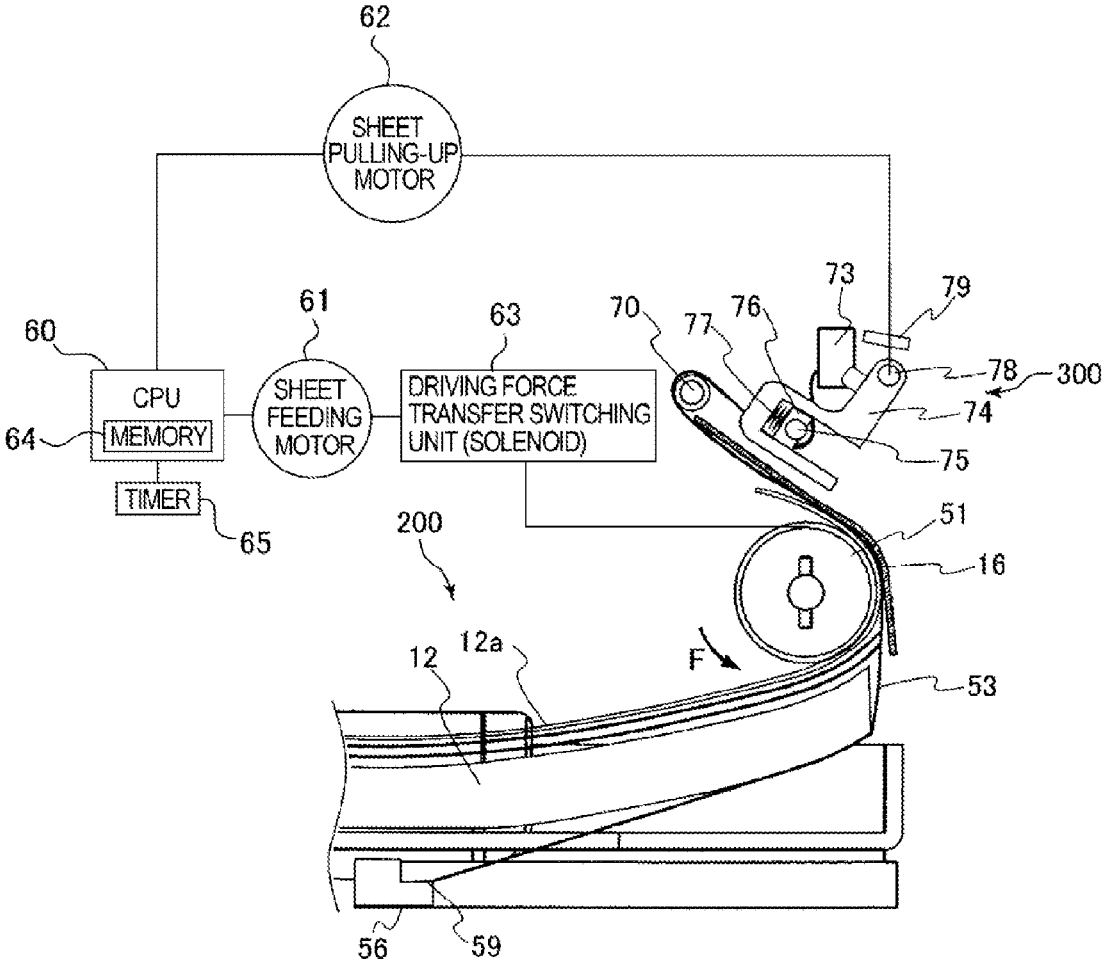

After the sheet feeding roller 51 has further rotated, the front end of the uppermost sheet 12*a* sent by the sheet feeding roller 51 comes in contact with the sheet member 53, and then the sheet 12*a* is fed along the sheet member 53, and then between the sheet feeding roller 51 and the sheet member 53 as shown in FIG. 15B. At that time, a feeding force generated by the rotation of the sheet feeding roller 51 is also transferred to the sheets 12 other than the uppermost sheets 12*a* by friction between the sheets 12 stacked in the sheet tray 55. However, since the abutment pressure between the sheet 12 and the sheet feeding roller 51 is optimally set based on the driving voltage for the sheet pulling-up motor 62, only the uppermost sheet 12*a* is separated from the other sheets 12 while being curved along the sheet member 53, and fed upward.

Figure 16:
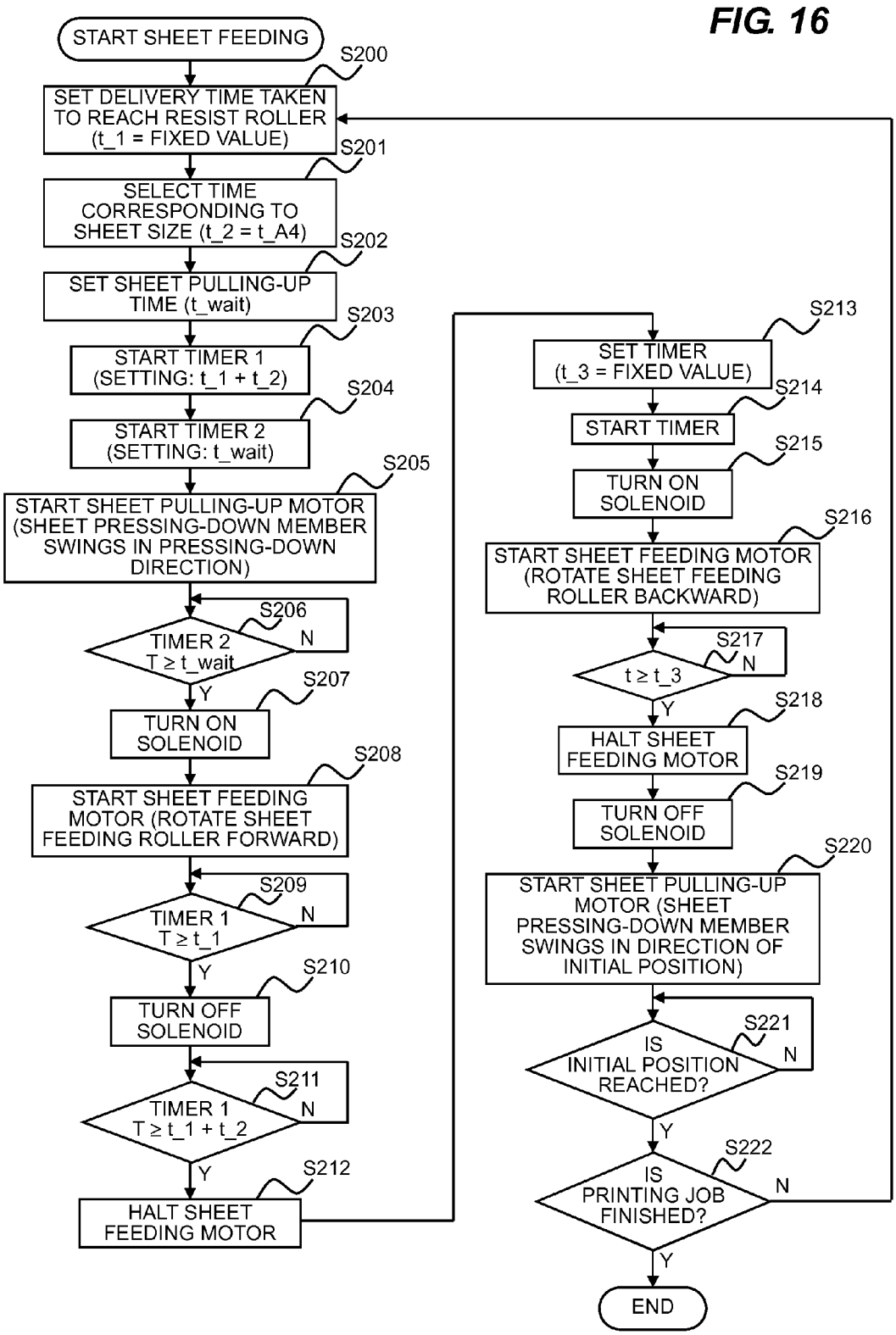
FIG. 16 is a flowchart of the sheet feeding operation of the sheet feeding device according to the third embodiment.
Figure 17:
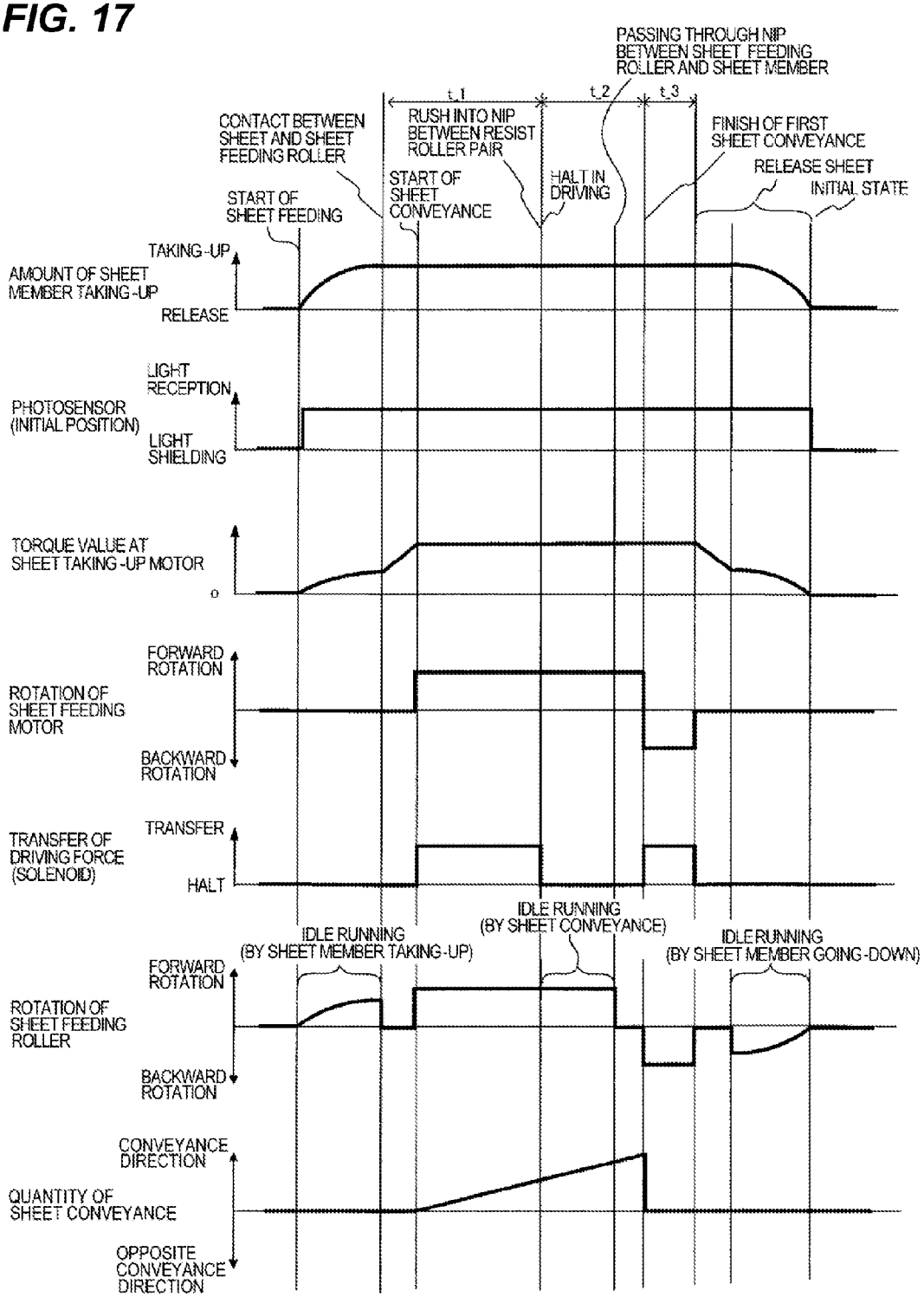
FIG. 17 is a timing chart of the sheet feeding operation of the sheet feeding device according to the third embodiment.

Next, the control of the sheet feeding according to the third embodiment will now be described with reference to a flowchart of FIG. 16 and a timing chart of FIG. 17. To begin with, the CPU 60 sets a delivery time t1 (a fixed value) taken for each sheet 12 to reach the resist roller 15 before the start of the driving of the sheet feeding motor 61 (step S200). Note that, the delivery time t1 can be set as a sufficient time for the front end of each sheet to reach the resist roller 15 without regard to sheet size.

Then a rotation time (a period of time) t2 for the sheet feeding motor 61 corresponding to the size of the sheets 12 is selected from the data table preloaded in the memory 64 in the CPU 60 (step S201). In the data table are presented rotation times for the sheet feeding motor 61 necessary for the back ends of various-size sheets to pass through the nip portion between the sheet feeding roller 51 and the sheet member 53. For example, in cases where A4-size sheets are used, a rotation time tA4 for the sheet feeding motor 61 is selected. Then a sheet pulling-up time (t_wait), which is a sufficient pressing-down time for the sheet pressing-down member 74 to apply a predetermined load, is selected (step S202). Thereafter, the timer 65 is set for a rotation time (t1+t2) for the sheet feeding motor 61 and the sheet pulling-up time (t_wait) at the time of the feeding of the individual sheets 12.

Next, the timer 65, in which the rotation time (t1+t2) for the sheet feeding motor 61 is set, is started (step S203), and at the same time the timer 65, in which the sheet pulling-up time (t_wait) is set, is started (step S204). Note that, to set a rotation time (t1+t2) and a sheet pulling-up time (t_wait), two timers can be used; however, in this embodiment, both times are set using a single timer. Then the sheet pulling-up motor 62 is started (step S205), and the sheet pressing-down member 74 is swung in the pressing-down direction, i.e., downward, whereby the upper portion of the sheet member 53 is pressed down.

Thereafter, when a measured time T shown by the timer has exceeded or equated with the sheet pulling-up time (t_wait) (T≥t_wait) (Y in step S206), the uppermost sheet 12*a*, as shown in FIG. 15A, is pressed on the sheet feeding roller 51 by the sheet member 53, the upper portion of which has been pressed down. Then the solenoid 63 is turned on (step S207), and the sheet feeding motor 61 is started (step S208) to rotate the sheet feeding roller 51 forward.

By rotating the sheet feeding roller 51 forward, the feeding of the uppermost sheet 12*a* is started. The uppermost sheet 12*a* is fed along the sheet member 53, and then between the sheet feeding roller 51 and the sheet member 53 as shown in FIG. 15B. Note that, by pressing the uppermost sheet 12*a* on the sheet feeding motor 51 like this and then starting the sheet feeding motor 61, the sheet feeding roller 51 can be rotated after the sheet feeding pressure has reached the predetermined value sufficiently, whereby higher sheet feeding performance can be exhibited.

Then the sheet 12*a* is delivered to the resist roller 15; when a measured time T shown at that time exceeds or equates with the delivery time t1 (T≥t1) (Y in step S209), the solenoid 63 is turned off to halt the driving force transfer (step S210). Thereafter, the back end of the sheet 12*a* passes through the nip portion between the sheet feeding roller 51 and the sheet member 53; when a measured time T shown at that time exceeds or equates with the rotation time (t1+t2) for the sheet feeding motor 61 (T≥t1+t2) (Y in step S211), the sheet feeding motor 61 is halted (step S212), whereby the feeding of the first sheet is finished.

At that time, there is a case where some of the sheets 12 other than the uppermost sheets 12*a* are fed partway together with the uppermost sheet 12*a*. Hence, in this embodiment, to return the sheet(s) 12 fed partway, the solenoid 63 is turned on, and the sheet feeding motor 61 is rotated backward to rotate the sheet feeding roller 51 backward in the direction of the arrow R shown in FIG. 14A. Specifically, after the finish of the feeding of the first sheet, the timer is set only for a backward rotation time t3 (a fixed value) (step S213), following which the timer is started (step S214).

Next, the solenoid 63 is turned on (step S215), and then the backward rotation of the sheet feeding motor 61 is started (step S216). Since the solenoid 63 is in the ON state at that time, the sheet feeding roller 51 rotates backward. Thereafter, elapsed time is measured based on a count by the internal clock. When the measured time t exceeds or equates with the backward rotation time t3 (t≥t3) (Y in step S217), the sheet feeding motor 61 is halted (step S218), following which the solenoid 63 is turned off (step S219), whereby the sheet(s) fed partway can be returned.

Then the backward rotation of the sheet pulling-up motor 62 is started (step S220), and the sheet pressing-down member 74 is swung upward, i.e., in the direction of its initial position shown by an arrow D in FIG. 14A to make the sheet member 53 go down. When the sheet pressing-down member 74 has returned to the initial position at which the light-shielding member 79*a* shields the photosensor 79 from light (Y in step S221), the sheet pulling-up motor 62 is halted. At that time, the sheet feeding roller 51 can rotate freely by the turning off of the solenoid 63, and thus the movement of the sheet member 53 is not impeded by frictional resistance produced by contact with the sheet feeding roller 51.

Note here that, even in the case where the front edges of the sheets 12 are not evened up when the sheet member 53 goes done like this, the front edges are evened up when the sheets 12 returns into the sheet tray 55 with the movement of the sheet member 53. That is, even when some of the sheets 12 other than the uppermost sheet 12*a* are pulled in the nip portion between the sheet feeding roller 51 and the sheet member 53, the sheet(s) 12 pulled in slips down along the sheet member 53 when the sheet member 53 goes down, and then the sheets 12 return to their initial position with the front edges evened up. In this way, when the sheet member 53 has gone down at the time of the return of the sheet pressing-down member 74 to the initial position, the sheets 12 other than the uppermost sheet 12*a*, remaining on the sheet tray 55, are stacked up with the front edges evened up, whereby a preparation for the next sheet feeding operation can be made. Thereafter, the above job is repeated until printing job is finished (Y in step S222).

As described above, according to this embodiment, since the driving of the sheet pressing-down member 74 and the driving of the sheet feeding roller 51 can be controlled separately, the rotation of the sheet feeding roller 51 can be started after the application of the sufficient sheet feeding pressure. Therefore, rectilinearity of sheet feeding is increased, and the occurrence of feeding failures, such as skew feeding, can be reduced. Further, a reliable sheet feeding device, which does not degrade the quality of printed matter and rarely causes paper jams and skew feeding with downsizing achieved, can be provided in this embodiment as well.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2011-150965, field Jul. 7, 2011, which is hereby incorporated by reference herein in its entirety.

What is claimed is:

1. A sheet feeding device comprising:

a sheet storing portion in which sheets are stored;

a feeding roller placed above the sheet storing portion that feeds the sheets;

a flexible member that contacts a part of a peripheral surface of the feeding roller and a first end of the flexible member is fixed to the sheet storing portion at a position below the stored sheets;

a rotating member that is connected to a second end of the flexible member above the sheet storing potion; and a motor which rotates the rotating member to take up the flexible member, wherein the flexible member is pulled up by rotation of the rotating member by the motor to press the sheets stored in the sheet storing portion against the feeding roller and the sheets pressed to the feeding roller are fed by a rotation of the feeding roller along a path between the feeding roller and the flexible member.

2. The sheet feeding device according to claim 1, wherein the rotating member rotates in conjunction with the rotation of the feeding roller to take up the flexible member.

3. The sheet feeding device according to claim 2, wherein the second end of the flexible member is fitted to the rotating member via a torque limiter.

4. A sheet feeding device comprising:

a swinging member that is swingable in a vertical direction in which sheets are stacked;

a feeding roller placed above the swinging member that feeds the sheets;

a flexible member that contacts a part of a peripheral surface of the feeding roller and a first end of the flexible member is fixed to the swinging member;

a rotating member that is connected to a second end of the flexible member above the swinging member; and a motor that rotates the rotating member to take up the flexible member, wherein the flexible member is pulled up by rotation of the rotating member by the motor to press the sheets stacked on the swinging member against the feeding roller and the sheets pressed to the feeding roller are fed by a rotation of the feeding roller along a path between the feeding roller and the flexible member.

5. A sheet feeding device comprising:

a sheet storing portion in which sheets are stored;

a feeding roller placed above the sheet storing portion that feeds the sheets;

a flexible member that contacts a part of a peripheral surface of the feeding roller and a first end of the flexible member is fixed to the sheet storing portion at a position below the stored sheets;

a fixing portion to which the second end of the flexible member is fixed;

a pressing-down member that presses down the flexible member between the fixing portion and the feeding roller to bend the flexible member; and a driving portion that drives the pressing-down member to press down the flexible member, wherein the pressing-down member presses down the flexible member to pull up the flexible member while bending the flexible member and that the driving portion halts at a point in time when a predetermined load is applied.

6. An image forming apparatus comprises:

an image forming portion that forms an image on sheets; and a sheet feeding device that feeds the sheets to the image forming portion, the sheet feeding device comprising:

a sheet storing portion in which the sheets are stored;

a feeding roller placed above the sheet storing portion that feeds the sheets;

a flexible member that contacts a part of a peripheral surface of the feeding roller and a first end of the flexible member is fixed to the sheet storing portion at a position below the stored sheets;

a rotating member that is connected to a second end of the flexible member above the sheet storing portion; and a motor which rotates the rotating member to take up the flexible member, wherein the flexible member is pulled up by rotation of the rotating member by the motor to press the sheets stored in the sheet storing portion against the feeding roller and the sheets pressed to the feeding roller are fed by a rotation of the feeding roller along a path between the feeding roller and the flexible member.

7. The image forming apparatus according to claim 6, wherein the rotating member rotates in conjunction with a rotation of the feeding roller to take up the flexible member.

8. The image forming apparatus according to claim 7, wherein the second end of the flexible member is fitted to the rotating member via a torque limiter.

9. An image forming apparatus comprises:

an image forming portion that forms an image on sheets; and a sheet feeding device that feeds the sheets to the image forming portion, the sheet feeding device comprising:

a swinging member that is swingable in a vertical direction in which sheets are stacked;

a feeding roller placed above the swinging member that feeds the sheets;

a flexible member that contacts a part of a peripheral surface of the feeding roller and a first end of the flexible member is fixed to the swinging member;

a rotating member that is connected to a second end of the flexible member above the swinging member; and a motor that rotates the rotating member to take up the flexible member, wherein the flexible member is pulled up by rotation of the rotating member to press the sheets stacked on the swing member against the feeding roller and the sheets pressed to the feeding roller are fed by a rotation of the feeding roller along a path between the feeding roller and the flexible member.

10. An image forming apparatus comprises:

an image forming portion that forms an image on sheets; and a sheet feeding device that feeds the sheets to the image forming portion, the sheet feeding device comprising:

a sheet storing portion in which sheets are stored;

a feeding roller placed above the sheet storing portion that feeds the sheets;

a flexible member that contacts a part of a peripheral surface of the feeding roller and a first end of the flexible member is fixed to the sheet storing portion at a position below the stored sheets;

a fixing portion to which the second end of the flexible member is fixed;

a pressing-down member that presses down the flexible member between the fixing portion and the feeding roller to bend the flexible member; and a driving portion that drives the pressing-down member to press down the flexible member, wherein the pressing-down member presses down the flexible member to pull up the flexible member while bending the flexible member and that the driving portion halts at a point in time when a predetermined load is applied.

* * * * *